US009892882B1

(12) United States Patent
Fleming et al.

(10) Patent No.: US 9,892,882 B1
(45) Date of Patent: Feb. 13, 2018

(54) INVERTED MAGNETRON WITH AMPLIFYING STRUCTURE AND ASSOCIATED SYSTEMS AND METHODS

(71) Applicant: The United States of America as represented by the Secretary of the Air Force, Washington, DC (US)

(72) Inventors: Timothy Paul Fleming, Edgewood, NM (US); Michael Raymond Lambrecht, Albuquerque, NM (US); Peter Jerome Mardahl, Albuquerque, NM (US); John Davis Keisling, Belen, NM (US)

(73) Assignee: THE UNITED STATES OF AMERICA AS REPRESENTED BY THE SECRETARY OF THE AIR FORCE, Washington, DC (US)

( * ) Notice: Subject to any disclaimer, the term of this patent is extended or adjusted under 35 U.S.C. 154(b) by 0 days.

(21) Appl. No.: 15/487,763

(22) Filed: Apr. 14, 2017

(51) Int. Cl.

| | |
|---|---|
| ***H01J 25/50*** | (2006.01) |
| ***H01J 23/36*** | (2006.01) |
| ***H01J 23/24*** | (2006.01) |
| ***H01J 23/40*** | (2006.01) |
| ***H01J 23/38*** | (2006.01) |

(52) U.S. Cl.
CPC ..... *H01J 23/24* (2013.01); *H01J 23/38* (2013.01); *H01J 23/40* (2013.01)

(58) Field of Classification Search
CPC ..... H01J 23/24; H01J 23/38; H01J 23/40
See application file for complete search history.

(56) References Cited

U.S. PATENT DOCUMENTS

| | | | | |
|---|---|---|---|---|
| 4,041,350 | A * | 8/1977 | Shitara | B23P 15/00 315/39.51 |
| 4,169,987 | A * | 10/1979 | Oguro | H01J 23/15 313/270 |
| 5,635,797 | A * | 6/1997 | Kitakaze | H01J 23/05 315/39.51 |
| 2002/0043937 | A1 * | 4/2002 | Ogura | H01J 23/005 315/39.51 |
| 2004/0140207 | A1 * | 7/2004 | Lee | H01J 23/18 204/298.14 |

(Continued)

*Primary Examiner* — Tung X Le
*Assistant Examiner* — Raymond R Chai
(74) *Attorney, Agent, or Firm* — James M. Skorich

(57) ABSTRACT

A magnetron characterized by a supporting cylinder, a field emission cathode, a slow wave structure, and a waveguide. The slow wave structure includes an anode block positioned coaxial with and surrounded by the field emission cathode. The anode block includes sixteen radially-projecting vane panels defining sixteen resonant cavities therebetween. Each of the resonant cavities may comprise a resonant channel portion positioned radially proximate to and axially coextensive with a center axis of the anode block. A void between the anode block and the field emission cathode, along with the resonant cavities, define an interaction region. The waveguide, comprising a cylinder characterized by an exterior layer surrounding an interior void, is capacitively coupled to the slow wave structure and configured to deliver radio frequency (RF) energy extracted from the interaction region by one (or, optionally, two) excitation rings mounted at a downstream end of the anode block.

20 Claims, 19 Drawing Sheets

(56) References Cited

U.S. PATENT DOCUMENTS

2010/0052501 A1* 3/2010 Ueda ..... B23K 1/0008
313/271
2014/0191657 A1* 7/2014 Miyamoto ..... H01J 23/20
315/39.75

* cited by examiner

INVERTED MAGNETRON WITH AMPLIFYING STRUCTURE AND ASSOCIATED SYSTEMS AND METHODS

GOVERNMENT INTEREST

The invention described herein may be manufactured and used by or for the Government of the United States for all governmental purposes without the payment of any royalty.

FIELD OF THE INVENTION

The present invention relates to magnetrons. More specifically, this invention pertains to a compact and efficient magnetron design for delivery of high power microwave (HPM) radiation, and associated systems and methods.

BACKGROUND OF THE INVENTION

Traditional relativistic magnetrons used for HPM generation suffer from several limitations that reduce their effectiveness and/or efficiency. Among these limitations are 1) very high voltage operation, 2) small cathode surface area, 3) high axial confining magnetic field, 4) large device size, 5) inefficient mode conversion, and 6) downstream current loss.

High voltage operation and small cathode surface area share a relationship that has historically proven to be problematic. For a relativistic magnetron, HPM generation may only occur if high electromagnetic power (of the order of Gigawatts) is delivered to the device. For relativistic magnetrons, a pulsed power system is typically utilized to deliver this power. However, for field emitting cathodes, the electric current emitted is limited by the cathode surface area. For a standard relativistic magnetron, this cathode must be smaller than the outer hull of the device where the anode/slow wave structure is located. Consequently, for high electromagnetic power P to be delivered to the magnetron, high voltages V must be used to compensate for the limitations on current I (P=IV).

In a standard relativistic magnetron, confinement of the electron beam typically requires a magnetic field ranging from 0.12-0.32 T. Traditionally, Helmholtz coils have been used to provide this field, thus the power burden of an HPM system includes the energy necessary to generate the current in the coils. The inefficiency of input energy versus output has been a debilitating factor in traditional magnetrons.

Magnetron size has also been a limiting factor for HPM system deployment and use. Relativistic magnetrons used in traditional HPM systems typically exceed a 10 cm radius, thus presenting a logistical challenge to their deployment on compact mobile platforms. The size problem of traditional relativistic magnetrons is compounded when the magnetron's radio frequency (RF) extraction method is considered. Standard relativistic magnetrons extract radially through one or more of the resonant cavities of the device. This often results in a network of slots and waveguides that further increase the size and weight of the device. Additionally, when multi-slot RF extraction schemes are used, a combiner and mode converter are used to combine the RF signal. This additional componentry increases the size and weight of traditional HPM systems.

Another problem with traditional HPM systems is downstream current loss. Leakage of current beyond the magnetron interaction region degrades performance and may suppress oscillation.

A need exists for a magnetron design that reduces the necessary magnitude of the magnetic field and causes a reduction on the power requirements of the entire HPM system. Furthermore, advances in magnetron design are desirable that result in a compact implementation that delivers HPM radiation with minimal current loss (efficiency).

This background information is provided to reveal information believed by the applicant to be of possible relevance to the present invention. No admission is necessarily intended, nor should be construed, that any of the preceding information constitutes prior art against the present invention.

BRIEF SUMMARY OF THE INVENTION

With the above in mind, embodiments of the present invention are related to a compact high power, low voltage, relativistic Inverted Magnetron Oscillator (IMO) for generating electromagnetic waves. The IMO may comprise a first end defined as an upstream end, and a second end positioned axially opposite the first end of the magnetron, and defined as a downstream end. The IMO may comprise a breech portion at the first end and comprising an upstream opening, a cylindrical passage, an upstream taper, and a reflector chamber in communication with the cylindrical passage. At least a portion of the magnetron may be configured to be operable within a magnetic field. The breech portion may be configured to receive pulsed input energy.

The IMO may further comprise a slow wave structure including an anode block characterized by an anode block first end, an anode block body, an anode block second end, and a plurality of vane panels. Each of the vane panels may be characterized by vane panel tips and each may alternate between positive and negative charges. Each of a plurality of resonant cavities defined by the vane panels may comprise a respective resonant channel positioned radially proximate to and axially coextensive with a center axis of the anode block.

The IMO may further comprise a field emission cathode surrounding the anode block, defining an interaction region therebetween. An RF extraction mechanism may comprise a first excitation ring connected to the anode block at alternating vane panels by a first plurality of connecting rods, and, optionally, a second excitation ring connected to the anode block by a second plurality of connecting rods at vane panels not connected to the first plurality of connecting rods.

The IMO may further comprise a waveguide capacitively coupled to the slow wave structure, and positioned proximate the downstream end of the magnetron. The waveguide may be configured to shape electromagnetic waves received from the RF extraction mechanism.

In the present invention, there are three structural elements that allow bypass of a combiner. The first is the slow wave structure which allows the device to operate in the $\pi$ mode. The second is the excitation ring which, because it is mounted on alternating vanes of the slow wave structure, oscillates from positive to negative (provided the device operates in the $\pi$ mode.) The third element is the downstream cylindrical waveguide.

The oscillating ring excites the $TM_{01}$ electromagnetic cylindrical mode (as a matter of definition, $TM_{mn}$ refers to a transverse magnetic mode for a circular waveguide where m is the number of full-wave patterns along the circumference of the waveguide and n is the number of half-wave patterns along the diameter of the waveguide). The downstream cylindrical carries the $TM_{01}$ mode away from the source. If an operator is interested in radiating a $TM_{01}$ mode then there is no need for a mode converter. There is no need for combiners in the present invention because all electromagnetic energy is propagated through the waveguide. For the electrons to give up their energy to the electromagnetic wave (mode) and thus create high power electromagnetic energy, the wave and the electron must be allowed to interact in a synchronous way. This typically requires the electron and the wave to travel at about the same speed. However, the electrons have mass and thus cannot travel at the speed of light. The solution in the present invention is to slow the wave down so that the electron and wave may interact for energy exchange to take place. The slow wave structure has the effect of slowing down the ambient electromagnetic wave in the interaction and thus allowing the energy exchange to take place The excitation rings of the present invention advantageously operate to extract electromagnetic energy. The terms "ring" and "RF extraction mechanism" may be used interchangeably because the ring is the key component for RF extraction. Because the ring is mounted on alternating vanes of the slow wave structure it (the ring) will have uniform polarity. This is because the slow wave structure allows the magnetron to operate in the $\pi$ mode. ($\Pi$ mode describes a condition where alternating vanes have identical polarity). This polarity will alternate with the alternating polarity of the vanes on which it (the ring) is mounted. The oscillations then excite the $TM_{01}$ mode of the cylindrical waveguide. The ring advantageously allows electromagnetic energy to leave the device (i.e. for radiation to occur).

A second ring may be mounted to the remaining vanes on which the first ring is not mounted. Thus, the second ring will have opposite polarity to the first ring. Because the second ring is approximately half a wavelength downstream of the first, the $TM_{01}$ mode that the second ring induces will interfere constructively with the mode generated by the first ring and thus boost the amplitude of the wave.

DETAILED DESCRIPTION OF THE INVENTION

Figure 1:
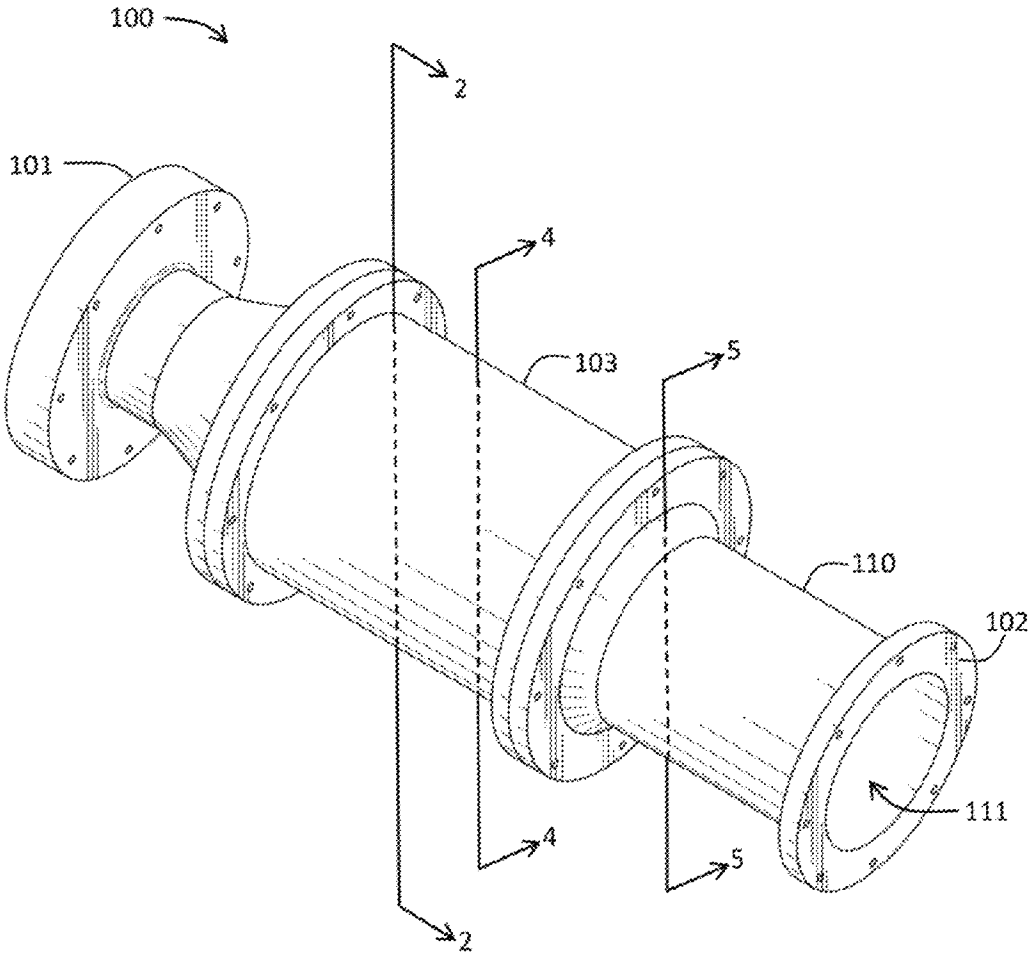
FIG. 1 is an assembled, perspective top view of a magnetron according to an embodiment of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout. Though approximate or actual physical dimensions may be disclosed or referenced herein, such dimensions are not intended to be limiting but to enable those of ordinary skill in the art to practice exemplary embodiments of the invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Referring to FIGS. 1-18, an Inverted Magnetron Oscillator (IMO) according to an embodiment of the present invention is now described in detail. Throughout this disclosure, the present invention may be referred to as a IMO system, an IMO device, a magnetron system, an inverted magnetron, a magnetron, a device, a system, a product, and a method. Those skilled in the art will appreciate that this terminology is only illustrative and does not affect the scope of the invention.

An embodiment of the invention, as shown and described by the various figures and accompanying text, provides a compact high power, low voltage, relativistic Inverted Magnetron Oscillator (IMO). For purpose of this disclosure, inverted shall mean that a cathode surrounds an anode block, as opposed to conventional magnetrons that commonly utilize a centrally located cathode with a surrounding anode.

The present invention overcomes the described problems in the art in that it is a compact, high power, relativistic Inverted Magnetron Oscillator (IMO). The IMO is capable of supporting π mode oscillations over a 50 kV wide window absent any significant mode competition at output RF power levels that, in many cases, exceed 500 MW for voltages lower than 360 kV. This operation is advantageously achieved with very low axial magnetic field (0.05-0.09 T), with no downstream current loss, and with RF field amplitudes that do not exceed the vacuum breakdown threshold.

Several features of the IMO are innovative and produce a clear advantage over current standard relativistic magnetron designs. First, the IMO is compact. In the exemplary embodiment, the IMO has a radius of approximately 10 cm and an axial length of approximately 60 cm and is a relatively small magnetron when considering the operating voltages, magnetic fields, output power and frequency described herein. Second, the IMO has a large cathode surface area. Due to the inverted nature of the design, the large cathode surface area advantageously allows for a greater current draw than standard relativistic magnetrons. The larger current means higher output power for lower voltages, making the compact IMO ideal for high power applications and enabling a significant decrease in size and weight of an HPM system that uses the IMO. Third, the IMO advantageously operates at magnetic fields that can be at or about a third less than those required for standard relativistic magnetrons, thus featuring greatly reduced power and size demands on the electromagnet or other sources that provides the magnetic field. Fourth, because the IMO radiates axially in the $TM_{01}$ mode directly into a cylindrical waveguide, multiple waveguides and combiners are not needed. Standard relativistic magnetrons radiate radially in multiple waveguides, thus increasing HPM system size and weight. Due to the single-cylinder axial waveguide design described herein, the IMO is not burdened with any of these disadvantages. Finally, the IMO does not produce any downstream current loss, a consequence faced by standard relativistic magnetrons.

The above list of features and advantages make the IMO ideal as the HPM source for a new smaller and lighter HPM system.

FIG. 1 illustrates the IMO 100 exterior. The IMO 100 may include a first end 101, referenced herein as an upstream end, and a second end, 102 referenced herein as a downstream end. The IMO 100 may include an exterior layer 103 that may extend from the first end 101 to the second end 102 of the IMO 100. For example, and without limitation, the exterior layer 103 may be characterized by a supporting cylinder that may function as a housing to an internal structure and componentry of the IMO 100.

Figure 2:
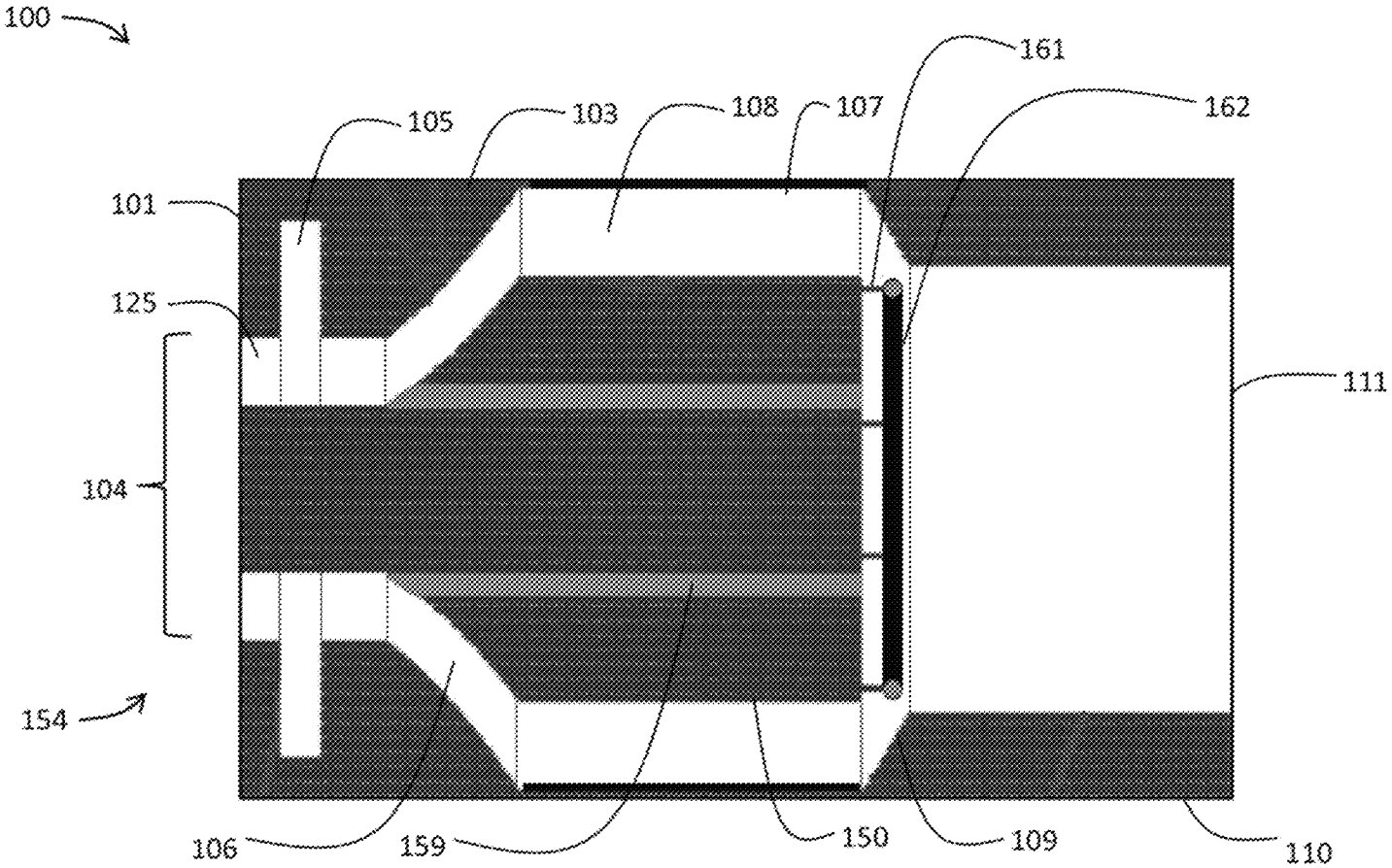
FIG. 2 is an assembled, side-sectional view of the magnetron illustrated in FIG. 1 including a first embodiment of an anode block and taken through line 2-2 of FIG. 1.

Referring additionally to FIG. 2, the internal structure may be positioned axially inward of the exterior layer 103 and may include an upstream opening 104, a reflector chamber 105, an upstream taper 106, a field emission cathode 107, an interaction region 108, a downstream taper 109, a waveguide 110, which in the exemplary embodiment is cylindrical, and a downstream opening 111. For example, and without limitation, the upstream opening 104 may be a threshold to a cylindrical passage located substantially proximate the first end 101 of the IMO 100.

Figure 3:
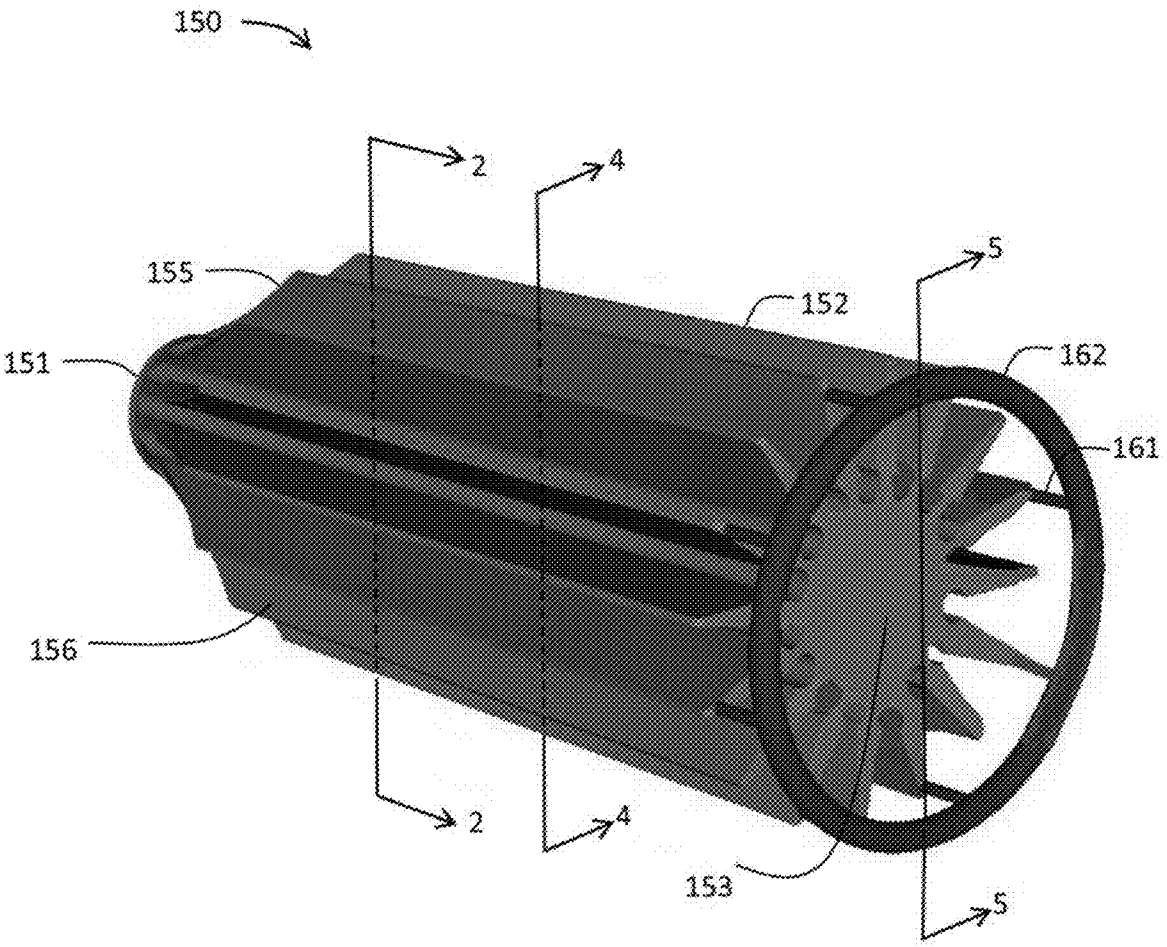
FIG. 3 is an assembled, perspective top view of the first embodiment of the anode block illustrated in FIG. 2.
Figure 4:
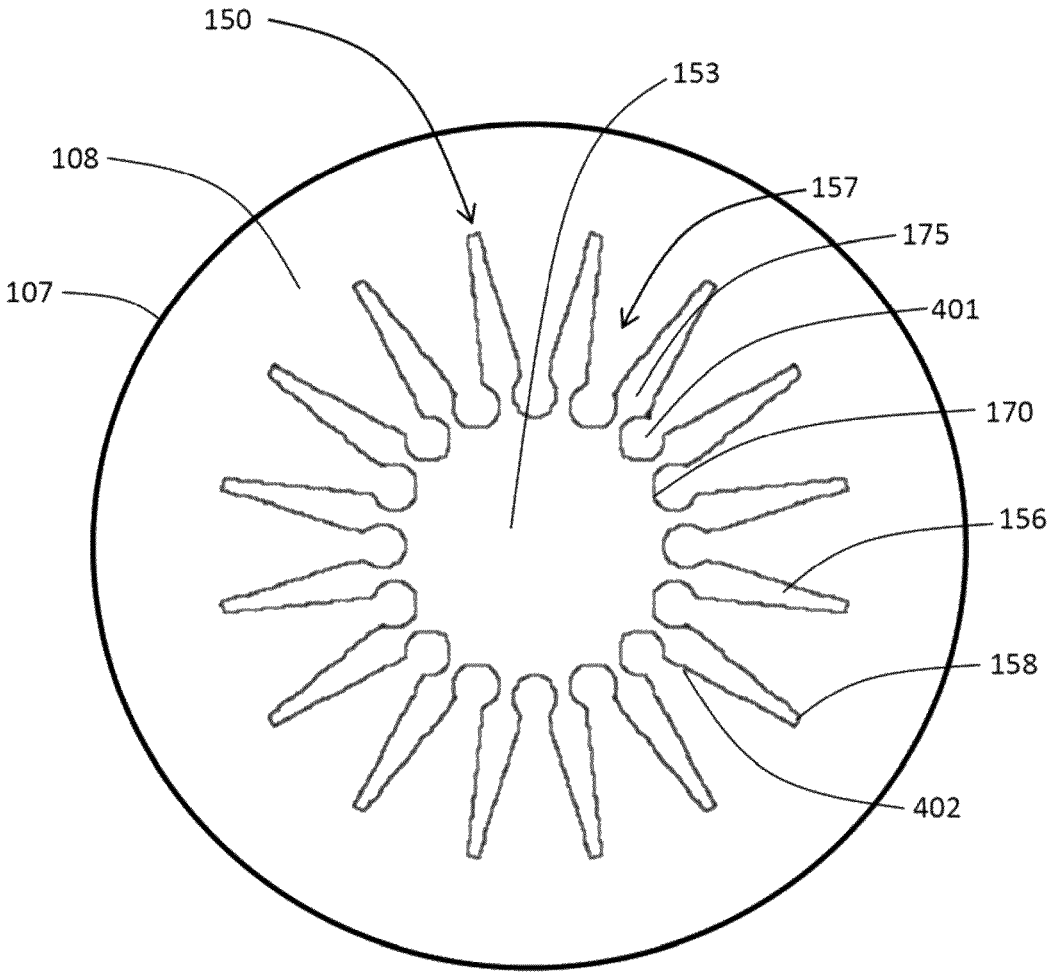
FIG. 4 is an assembled, upstream-sectional view of the magnetron illustrated in FIG. 1 taken through line 4-4 of FIG. 1.

Still referring to FIG. 2, and referring additionally to FIGS. 3 and 4, the internal componentry housed by the exterior layer 103 may include a slow wave structure defined as an anode block 150. For example, and without limitation, the anode block 150 may include an anode block first end 151, an anode block body 152, and an anode block second end 153. The anode block body 152 may be positioned coaxial with and surrounded by the field emission cathode 107. The anode block first end 151 and a plurality of vane panel tapers 155 may be positioned substantially proximate to a breech portion 154 of the IMO 100. For example, and without limitation, the breech portion 154 may include the upstream opening 104 positioned adjacent to a cylindrical passage 125 that may extend toward and may connect with the upstream taper 106. The reflector chamber 105 may connect distally with the cylindrical passage 125. Extending distally from the anode block second end 153 may be a first plurality of connecting rods 161 connected to an annular shaped torus, defined as a first excitation ring 162. The anode block body 152 may include a plurality of vane panels 156, adjacent pairs of which may define resonant cavities 157 therebetween. For example, and without limitation, each of the vane panel tapers 155 may be defined by a respective curved portion of the vane panels 156 that may extend from the anode block body 152 down to the anode block first end 151.

The slow wave structure/anode block 150 may enable the electrons to give up their energy to the electromagnetic wave (mode) and thus may create high power electromagnetic energy. This happens when the wave and the electron are allowed to interact in a synchronous way. This typically requires the electron and the wave to travel at about the same speed. However, the electrons have mass and thus cannot travel at the speed of light. The solution in the present invention is to slow the wave down so that the electron and wave may interact for energy exchange to take place. The slow wave structure/anode block 150 may have the effect of advantageously slowing down the ambient electromagnetic wave in the interaction and thus may allow energy exchange to take place.

In one embodiment of the present invention, as illustrated in FIG. 4, the anode block 150 may be characterized by sixteen resonant cavities 157 each defined between a respective pair of radially-projecting vane panels 156. In one embodiment, there may be sixteen vane panels 156. The vane panels 156 may be angled to specifically define the dimensions of the resonant cavities 157 between them. Each of the vane panels 156 may comprise a wedge portion 402 that may be adjoined to a respective resonant channel 159. For example, and without limitation, one segment of each vane panel 156 may include vane tips 158 and an opposing segment of each vane panel 156 may be defined by a respective adjacent pair of the resonant channels 159. The resonant channels 159 may be characterized as substantially circular cavities as observed from the IMO 100 first and second ends 101, 102, and may be substantially cylindrical cavities 159 as observed from a side-sectional view of the IMO 100. Therefore, the same voids within the anode block 150 may be described as resonant holes 401 when viewing the anode block first or second end 151,153, but may be described as resonant channels 159 when viewing the anode block 150 from the side. Each of the resonant channels 159 may present a respective open portion positioned radially-outward from a center axis of the anode block 150 which may form the segment of each resonant cavity 157 located radially proximate the anode block body 152. The resonant channels 159 may be substantially coaxial and collinear with the center axis of the anode block 150.

More specifically, each of the vane panels 156 may include a wide base 175 located proximate the resonant channels 159 and may include an opposing pair of sides that may angle toward each other to define narrowed vane tips 158. The vane panels 156 may be disposed substantially evenly along an interior perimeter 170 defined by the anode block body 152, and may project outward from the anode block body 152 with the wider base 175 located proximate the inner perimeter 170 and the narrowed vane tips 158 located distally thereto. As a result, the resonant cavities 157 produced by the vane panels 156 may be wider between the vane tips 158 and narrower toward the anode block body 152 inner perimeter 170.

Continuing to refer to FIG. 4, the field emission cathode 107 may be positioned relative to the anode block 150 so as to define an interaction region 108 of the IMO 100. For example, and without limitation, the field emission cathode 107 may be positioned adjacent to and carried by an interior surface of the exterior layer 103. The cathode 107 may be the origin of charged electron particles that generate HPM radiation. A uniform axial magnetic field may prevent the charged electron particles from immediately accelerating across the interaction region 108. Instead, the electron particles may undergo rotations about the field emission cathode 107. If the electron particles' azimuthal velocity component is approximately equal to the phase velocity of a particular electromagnetic mode in the interaction region 108, the possibility exists for energy exchange between the particle and the mode. This resonance is known as the Buneman-Hartree resonance condition, Benford, J., & Swegle, J. A. (1992). *High Power Microwaves*, Boston, Ma.: Artech House. As the electron particles rotate about the field emission cathode 107 they gradually give up their potential energy to a mode or modes of the RF field as they migrate toward the anode block 150. This interaction may create RF oscillations in the IMO 100.

In one embodiment, the field emission cathode 107 may measure an outer radius of between 9.9 cm and 10.2 cm and may establish an outer perimeter of the interaction region 108. In this embodiment, an outer radius of the field emission cathode 107 may be measured at 10.0 cm. An inner boundary of the interaction region 108 may be established by the anode block 150, which may measure at a radius of 7.1 cm from its center axis to its vane tips 158. The difference between the boundary established by the field emission cathode 107 measuring a radius of 10.0 cm and the boundary established by the anode block 150 measuring a radius of 7.1 cm may create an inter-boundary void surrounding the anode block 150. This inter-boundary void may define the interaction region 108. The axial length of both the field emission cathode 107 and the anode block body 152 (and, therefore, of the interaction region 108) may be identical and equal to 26.2526 cm.

For example, and without limitation, each of the vane panels 156 may present a respective angle that may measure 10.18 degrees with respect to a bisecting plane through an origin of that angle. Collectively, the vane panels 156 may define sixteen resonant cavities 157 therebetween. Each of the vane tips 158 may have a width of 0.25 cm. Circular voids, defined as resonant holes 401, may exist at the bottom of each resonant cavity 157 when viewing the anode block from the first or second end 151, 153 and may define the dimensions of the resonant channels 159 that may extend substantially the length of the anode block body 152. The resonant channels 159 are viewable from a side view of the anode block 150. A respective radius of each resonant hole 401 (and therefore resonant channel 159) may measure 0.509 cm and a respective center of each resonant hole 401 and resonant channel 159 may be distanced 3.406 cm from the center axis of the anode block 150. The resonant holes 401 and resonant channels 159 may exist to advantageously increase inductance and mode stability of the IMO 100, as well as to advantageously lower the IMO 100 resonant frequency. Additionally, each of the resonant cavities 157 may subtend a respective angle of 39.5 degrees with respect to the respective resonant holes 401 and resonant channels 159.

Figure 5:
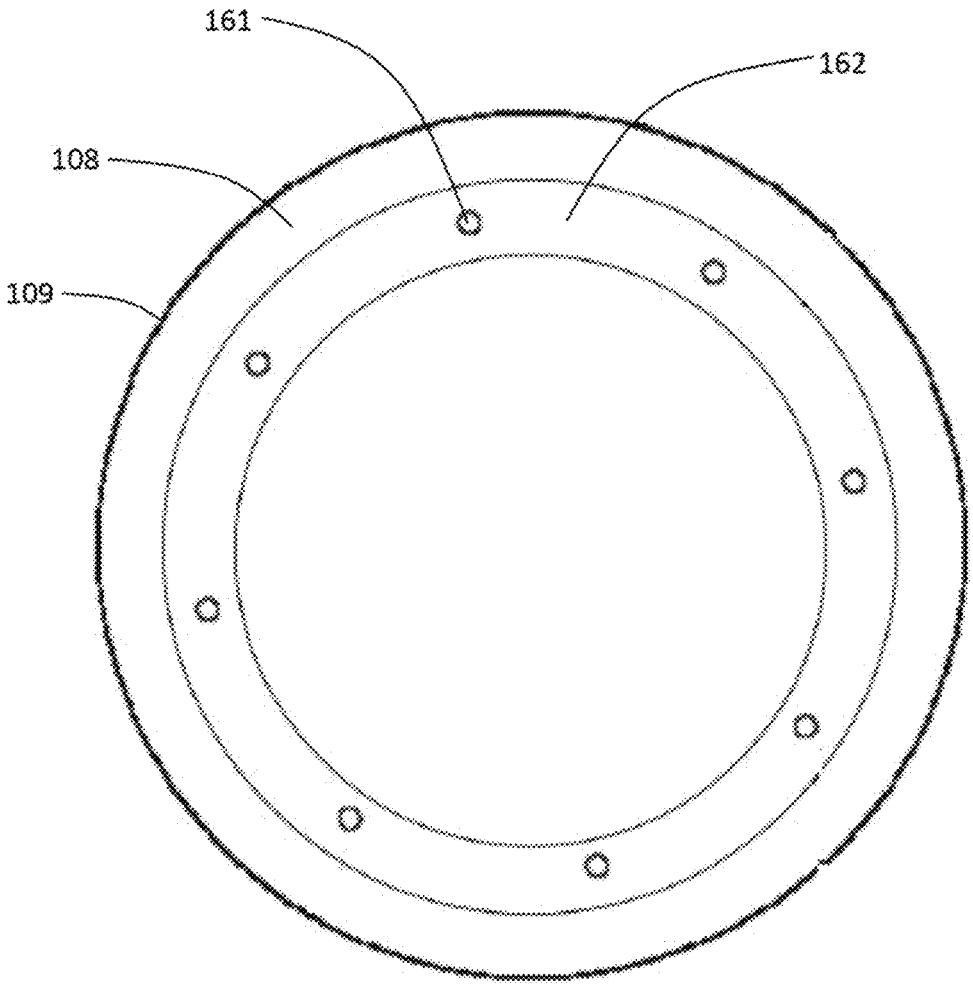
FIG. 5 is an assembled, upstream-sectional view of the magnetron illustrated in FIG. 1 taken through line 5-5 of FIG. 1.

Referring now to FIG. 5, an RF extraction mechanism used in accordance with an embodiment of the present invention will now be discussed. For example, and without limitation, FIG. 5 illustrates the RF extraction mechanism in the x-y plane where z=18.5 cm measured from the second end 102 of the IMO 100. This measurement may represent the axial coordinate where extraction of RF energy may be accomplished via the first excitation ring 162, otherwise known as a torus, that may be characterized by a major radius 6.6 cm and minor radius 0.45 cm. The first excitation ring 162 may be mounted on a first plurality of connecting rods 161, each characterized by a radius of 0.2 cm and a length of 1.8 cm. In one embodiment of the present invention, the first plurality of connecting rods 161 may be eight (8) in number. Referring additionally to FIG. 3, the first plurality of connecting rods 161 may be connected to alternating vane tips 158 of the anode block 150 at a radius of 6.6 cm as measured from a center of the first excitation ring 162. The first plurality of connecting rods 161 may extend distally from the vane tips 158 toward the downstream end 102 of the IMO 100. The first excitation ring 162 may be centered at axial coordinate z=18.5 cm, and at a distance of 2.245 cm from a downstream end of the anode block 150. The first excitation ring 162 may employ capacitive coupling with the cylindrical waveguide 110 to launch a $TM_{01}$ propagating mode therein.

The first excitation ring 162 may operate to extract electromagnetic energy. The terms "excitation ring" and "RF extraction mechanism" may be used interchangeably because the first excitation ring 162 advantageously operates as a component for RF extraction. Because the excitation ring 162 is mounted on alternating vane panels 156 of the anode block 150, the first excitation ring 162 may have uniform polarity. This is because the anode block 150 may allow the IMO 100 to operate in the $\pi$ mode. $\Pi$ mode describes a condition where alternating vane panels 156 have identical polarity. This polarity will alternate with the alternating polarity of the vane panels 156 on which the first excitation ring 162 is mounted. The oscillations then excite the TM01 mode of the cylindrical waveguide.

The cylindrical waveguide 110 may be characterized by a radius of 7.4 cm and may allow for propagation of the $TM_{01}$ mode out of the IMO 100 second end 102 and downstream opening 111.

Figure 6A:
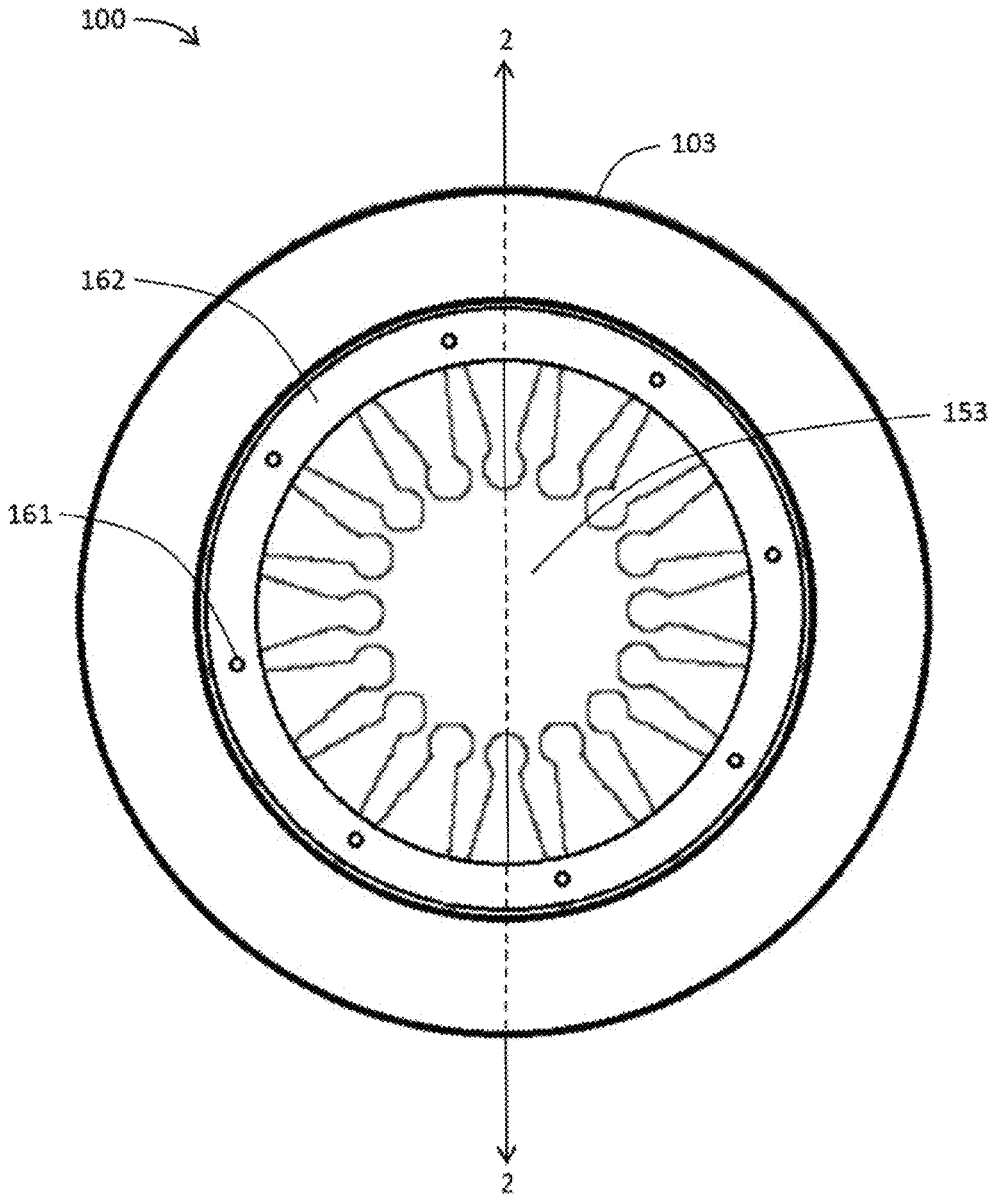
FIG. 6A is an assembled, exterior upstream view of the magnetron illustrated in FIG. 1.
Figure 6B:
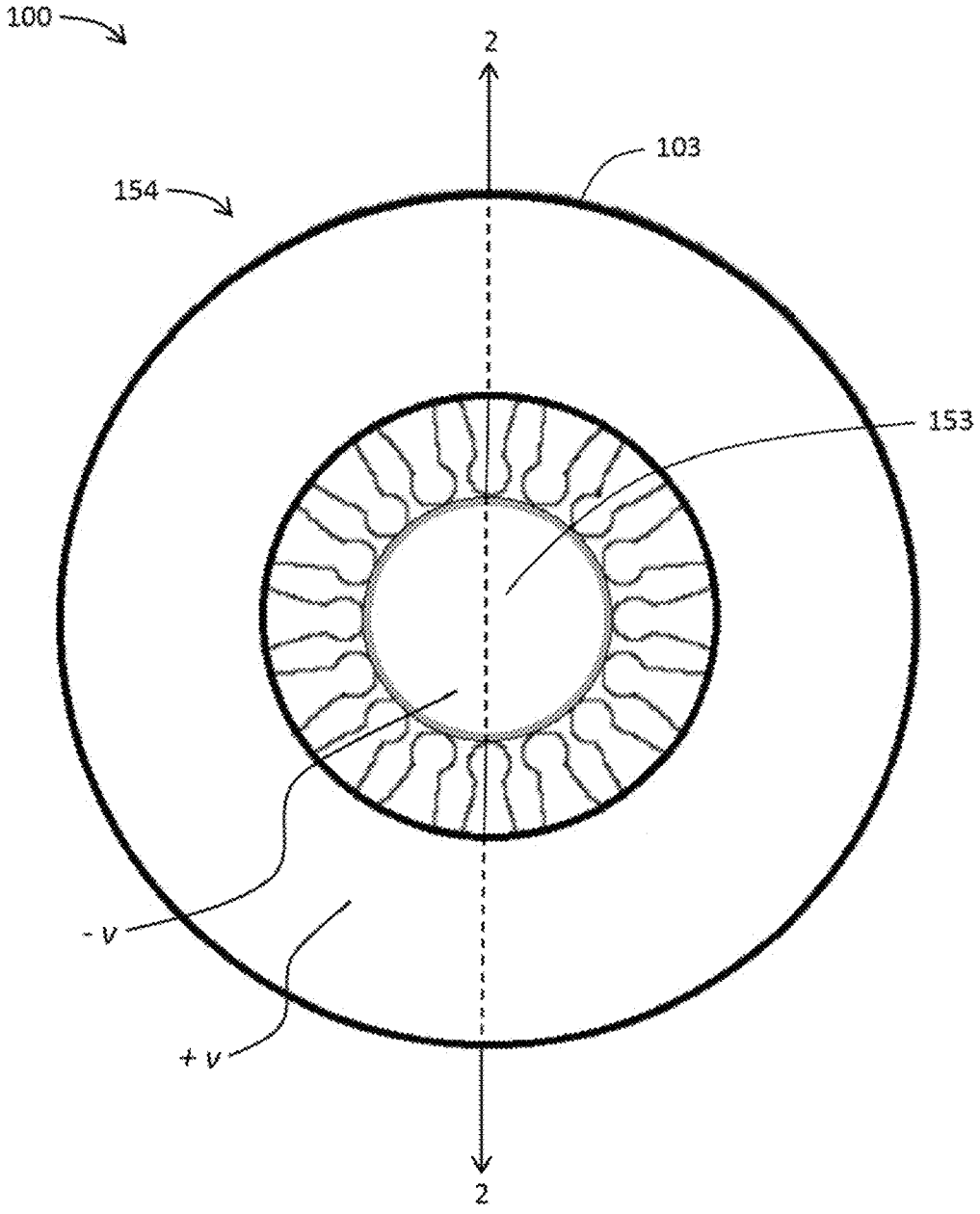
FIG. 6B is an assembled, exterior downstream view of the magnetron illustrated in FIG. 1.

Referring again to FIG. 2, and additionally to FIG. 6B, the breech portion 154 of the IMO 100 may be located at the IMO first end 101 and may present the upstream opening 104 defined between the exterior layer 103 and the anode block first end 151. The anode block first end 151, conductively coupled to the anode block 150, may be electrically insulated from the exterior layer 103, which is conductively connected to the field emission cathode 107 so that the potential difference applied at the upstream end 101 may be transmitted to and may serve as the diode voltage of the magnetron 100.

For example, and without limitation, the upstream opening 104 may measure an outer radius of 5 cm before tapering upward to the field emission cathode 107 characterized by a radius of 10.0 cm. The upstream taper 106 may be defined by a taper between the upstream opening 104 measuring a radius of 5 cm and the upstream end of the field emission cathode 107 measuring a radius of 10.0 cm. In some embodiments, the upstream taper 106 may be characterized as a flaring annular passage. The upstream taper 106 may represent a curved void within the exterior layer 103 that may surround the vane panel taper 155 of the anode block first end 151.

The anode block first end 151 may have a radius measuring 2.84 cm before tapering upward to form the vane panels 156 of the anode block 150 that extend to radii of 7.1 cm to the vane tips 158. To form the upstream taper 106, its outer radius may be characterized by the relation $$R_o=0.05e^{(6.9348(z-z_0))}$$

where $R_o$ is the outer radius, $z_o$ is the coordinate for the starting point for the upstream taper 106, and $z_o=-2$ cm where z is the axial coordinate. The inner radius may be characterized by the relation $$R_i=0.0284e^{(9.16(z-z_o))}$$

where $R_i$ represents the inner radius of the upstream taper 106.

Still referring to FIG. 2, located proximate to the IMO first end 101 and downstream of the breach portion 154 may be a reflector chamber 105. For example, and without limitation, the reflector chamber 105 may be a cylindrically shaped void within the exterior layer 103 measuring 3 cm in width, extending from z=−0.28 cm to z=−0.25 cm, and characterized by an inner radius of 5 cm and outer radius of 8.85 cm. The cylindrically shaped void of the reflector chamber 105 may be positioned perpendicular to the center axis of the anode block 150 and adjacent the upstream opening 104, thereby combining the reflector chamber 105 and the cylindrical passage 125 defined between the upstream opening 104 and the upstream taper 106. During operation of the IMO 100, the reflector chamber 105 may advantageously prevent upstream RF energy loss by reflecting this energy back into the interaction region 108 of the IMO 100.

Located proximate to the anode block second end 153 and to a downstream end of the field emission cathode 107 may be a downstream taper 109. For example, and without limitation, the downstream taper 109 may define a taper in the exterior layer 103 formed by the difference in diameter between the field emission cathode 107 measuring a radius of 10.0 cm and the inner radius of the cylindrical waveguide 110 measuring 7.4 cm. In some embodiments, the downstream taper 109 may be defined as a frustoconical void.

FIGS. 7-12 graphically represent simulation data characterizing operation of the embodiment of the IMO 100 illustrated in FIGS. 1, 2, 3, 4, 5, 6A, and 6B. Those data are created using the Improved Concurrent Electromagnetic Particle-In-Cell code (ICEPIC), which utilizes the particle-in-cell (PIC) algorithm Hockney, R. & Eastwood J. (1988). *Computer Simulation Using Particles*. CRC Press. The PIC algorithm is used to solve Maxwell's equations and the relativistic Lorentz force law in the time domain on a fixed staggered grid. ICEPIC is designed to run on parallel architecture and thus meet the challenge of full 3D simulations of the MWC magnetron. The ICEPIC is a proven code that has been used in a number of high power relativistic magnetron studies Lemke, R. W., Genoni, T. C., & Spencer, T. A. (1999). Three-dimensional particle-in-cell simulation study of a relativistic magnetron. *Physics of Plasmas,* 6(2), 603-613; and Fleming, T., & Mardahi, P. (2009). Performance Improvements in the Relativistic Magnetron: The Effect of DC Field Perturbations. *IEEE Transactions on Plasma Science,* 37(11), 2128-2138. Also, referenced for prototyping design and identifying loss mechanisms. Spencer, T., Genoni, T., & Lemke, R. (2000). Effects that limit efficiency in relativistic magnetrons. *IEEE Transactions on Plasma Science,* 28(3), 887-897. ICEPIC has also been used to study conventional magnetron designs Luginsland, J. W., Lau, Y. Y., Neculaes, V. B., Gilgenbach, R. M., Jones, M. C., Frese, M. H., & Watrous, J. J. (2004). Three-dimensional particle-in-cell simulations of rapid start-up in strapped oven magnetrons due to variation in the insulating magnetic field. Applied Physics Letters, 84(26), 5425-5427.

Figure 7:
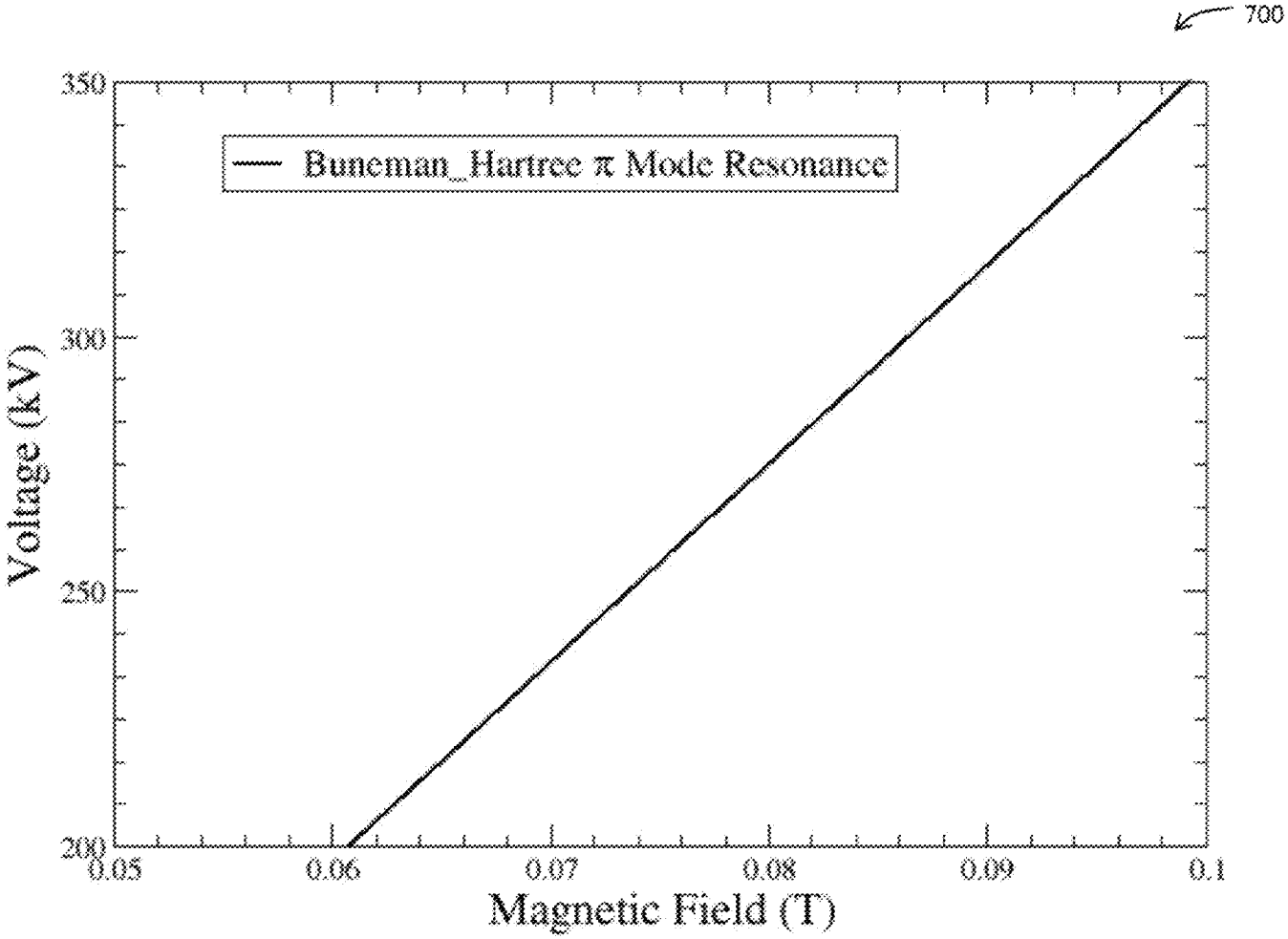
FIG. 7 is a graph illustrating $\pi$ mode resonance for the magnetron illustrated in FIG. 2.

Referring specifically to FIG. 7, utilizing the anode radii of 10.0 cm and 7.1 cm respectively, as well as the frequency of the π mode at 2 GHz, a non-interacting fluid model (single particle) of charged particles employing the Buneman-Hartree resonance condition and the Hull Cut-off condition in a smooth bore geometry yields the region in voltage-magnetic space over which the IMO 100 may oscillate in the π mode. Oscillations in the π mode typically occur right above the Buneman-Hartree π mode curve. Consequently, the presented simulations target this region of the voltage-magnetic field parameter space. Referencing the graph in FIG. 7, a resolution of one grid cell length equals 0.05 cm on a uniform Cartesian grid. With the cathode radius at 10 cm and the vane tips located at 7.1 cm, the simulated interaction region is well resolved at 58 grid cells. At this resolution, the grid volume as simulated was 668, 662, and 1758 cells in the x, y, and z directions, respectively, yielding a total of approximately 777 million grid points. Adding to this computational burden are the charged particle dynamics. Simulations produced about 330 million charged macro-particles.

Simulations of the presented magnitude may only be performed on large high performance computing resources. The presented simulations were carried out on a parallel computing platform using 256 Intel Xeon E5-2697 2.7 GHz cores. Each simulation required approximately 2.0 days to reach 200 ns of simulation time at which time saturation was well established.

A pulsed power device was used to provide the diode voltage (i.e., DC radial electric field) between the field emission cathode 107 and the anode block 150. The circuit and switches that constitute the pulsed power device were not modeled. Rather, a time dependent voltage function was used to emulate the behavior of the pulsed powered source. The voltage function was continuous and consisted of two parts. The first part was a 50 ns linear ramp up followed by a second part that was a constant voltage amplitude which lasted for the duration of the simulation. This amplitude was a free parameter that was manipulated in the presented simulations. Input voltages used in the presented simulations ranged from 200-400 kV.

A uniform axial magnetic field existed for the duration of the presented simulations. This field represented the insulating magnetic field that current carrying coils may generate. The coils may produce a magnetic field that may be uniform in the interaction region 108 and throughout most of the IMO 100.

The IMO 100 was simulated at magnetic fields of 0.05 T, 0.06 T, 0.07 T, 0.08 T, and 0.09 T. The voltage, V=375.0 kV, at B=0.07 T simulation served as the reference simulation for this IMO 100 embodiment. The dynamics of the IMO 100 presented are representative of all performed simulations. 375 kV was the dial up voltage and the resultant voltage was 353 kV.

Figure 8:
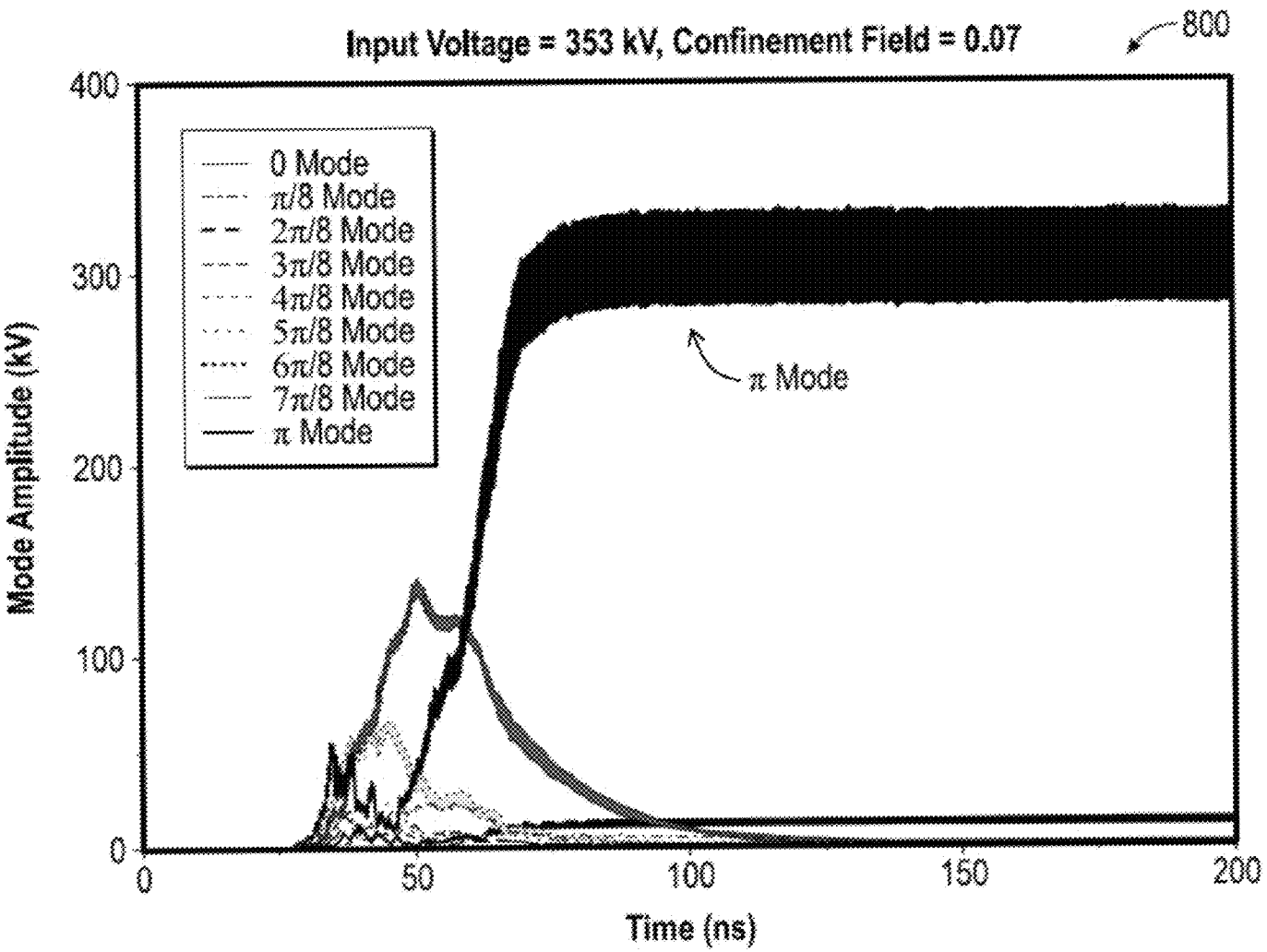
FIG. 8 is a graph illustrating evolution of magnetron modes as simulated for the magnetron illustrated in FIG. 2.

FIG. 8 illustrates the time evolution of the simulated magnetron modes. The simulation exhibited a transient period of mode competition primarily due to the 7π/8 mode during the ascent of the π mode. However, by 75 ns, the 7π/8 mode tended toward dissipation and the T mode was dominant. After this, time mode competition was confined to amplitudes less than 1 kV for each competing mode with the amplitude of the 7π/8 mode quickly decaying. The π mode remained the dominant mode at a frequency of approximately 2 GHz for the duration of the simulation.

Figure 9:
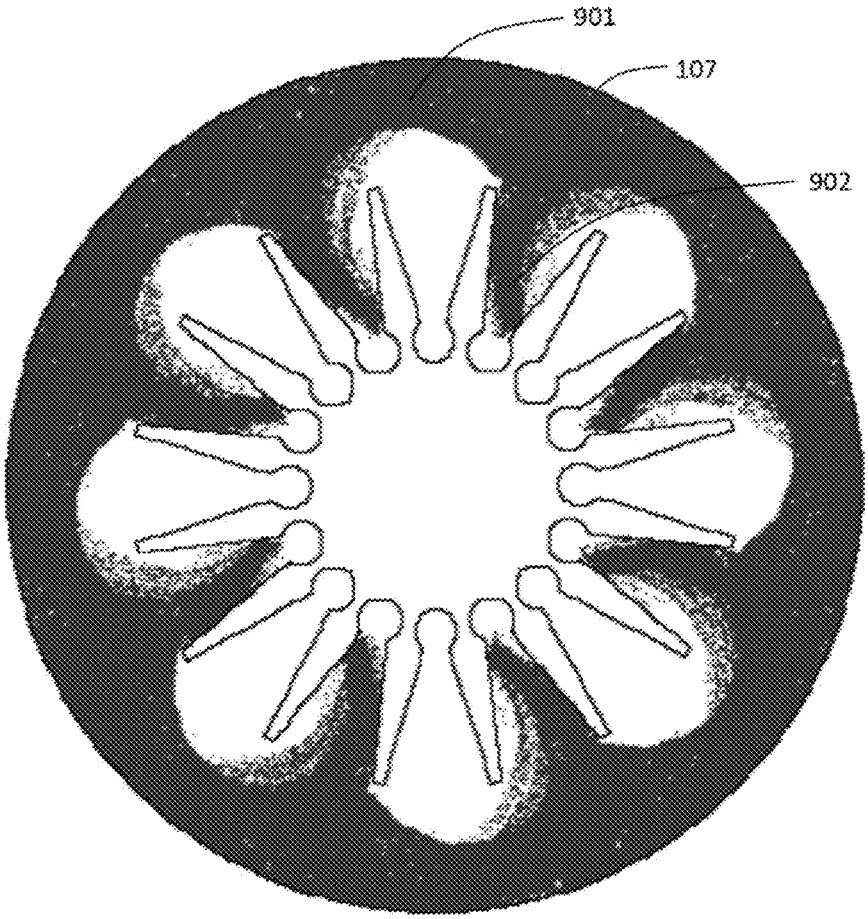
FIG. 9 is a schematic diagram illustrating spoking of particles as simulated for the magnetron illustrated in FIG. 2 and taken through line 4-4 of FIG. 1.

FIG. 9 displays the spoking pattern of particles in a sample slice of the interaction region 108 slice in the xy-plane of 2 dx thickness, and as simulated at 150 ns. For example, and without limitation, the IMO 100 was operating in π mode at saturation for input parameter, voltage=375 kV and magnetic field=0.07 T. Each particle is represented by a dot 901. Eight particle spokes 902, characteristic of the π mode in a sixteen-vane IMO 100, are evident.

RF output power is evaluated via the area integral of the outward Poynting flux. This integral covers the downstream cylindrical waveguide 110. The plane of integration was located downstream of the interaction region 108 and covered the entire surface area whose normal is the z-axis. RF output power at saturation was approximately 560 MW.

Output power efficiency is defined as the ratio of radiated power to system input power. Input power is given by P=IV, where I is the input current supplied to the field emission cathode 107 and V is the upstream diode voltage. This current is calculated by performing a closed path line integral of the magnetic field around the area in which the current is flowing. The voltage is determined by integrating the electric field radially. For the presented simulation, RF Power efficiency was 12.6% with an input current of 12.5 kA and a measured voltage of 353 kV. The operating IMO 100 exhibited no downstream leakage current.

An examination of critical areas within the IMO 100 with sufficiently high electric fields was conducted. Concern in high-power magnetron design included breakdown due to field stress. The Kilpatrick limit for breakdown in a magnetron operating at 2 GHz is approximately 390 kV/cm. Kilpatrick W. D., (September 1953), *Criterion for Vacuum Sparking Designed to Include Both RF and DC*, UCRL-2321. A survey of electrical field data at saturation throughout the volume of the IMO 100 indicated that the critical location for breakdown may be the downstream taper 109 just before the start of the cylindrical waveguide 110. Consequently, a thorough examination of field stresses at this location was carried out. Field stress data at the downstream taper 109 was produced during saturation over six oscillatory periods. Results indicated that the magnitude of the electric field component peaks near 300 kV/cm. Thus, RF breakdown was not problematic for the presented simulation. Furthermore, the axial magnetic field of B=0.07 T may act to insulate any charge flow along this direction, thus easily mitigating breakdown.

Figure 10:
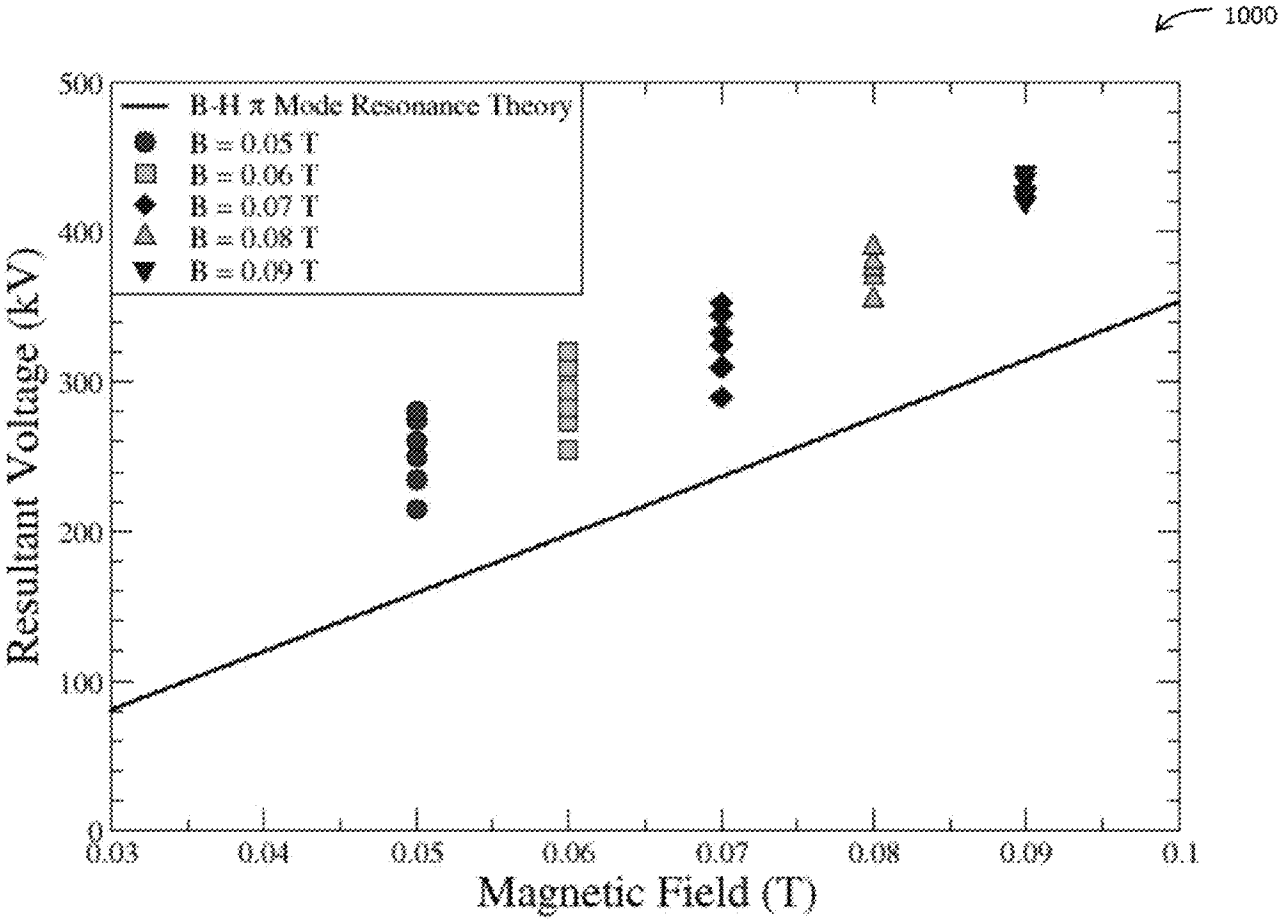
FIG. 10 is a graph illustrating oscillation in $\pi$ mode of the magnetron illustrated in FIG. 2 for sampled magnetic fields.

FIG. 10 is a graph of oscillation in π mode of the IMO 100 at approximately 50 kV increments for specifically sampled magnetic fields. This simulation is representative of the battery of runs performed from B=0.05 T to B=0.09 T. A minor period of mode competition present at startup, which may occur between 40-60 ns, tended toward decay once π mode saturation was reached. The IMO 100 operated in accordance with the Buneman-Hartree resonance condition. Operation was robust and predictable over the range of magnetic fields and voltages sampled. The voltage window for π mode oscillation for a given magnetic field was approximately 50 kV which advantageously may provide for advanced performance stability.

Figure 11:
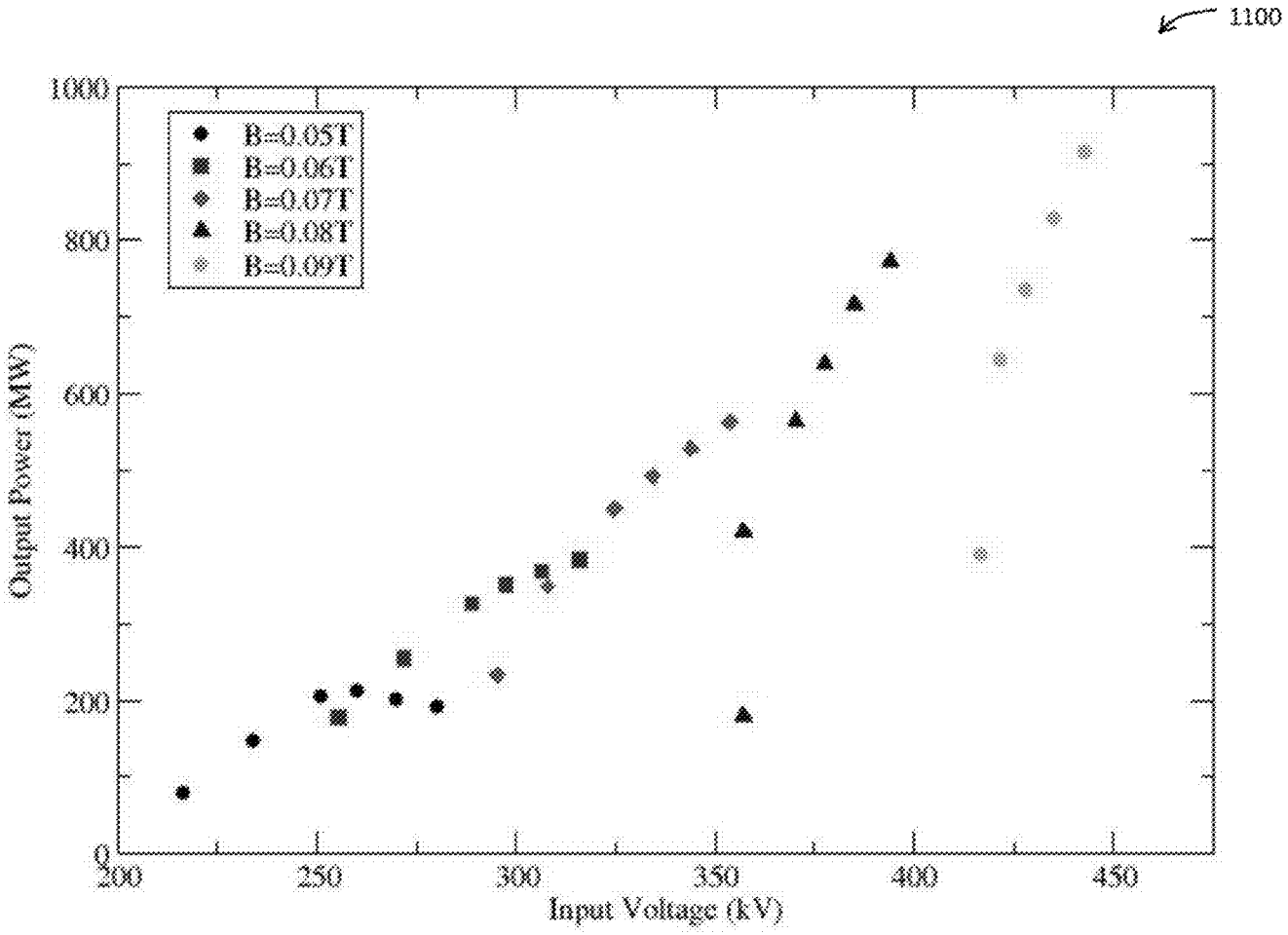
FIG. 11 is a graph illustrating output power of the magnetron illustrated in FIG. 2.

FIG. 11 displays the RF output power generated for all simulations. Every simulation tested successfully operated in the π mode. At approximately 350 kV and B=0.07 T the IMO 100 surpassed 0.5 GW in RF output power, thus demonstrating high power low voltage, low magnetic field performance. The IMO 100 exhibited significant RF generation over the range of voltages and magnetic fields examined. By 440 kV the IMO 100 was approaching a GW.

Figure 12:
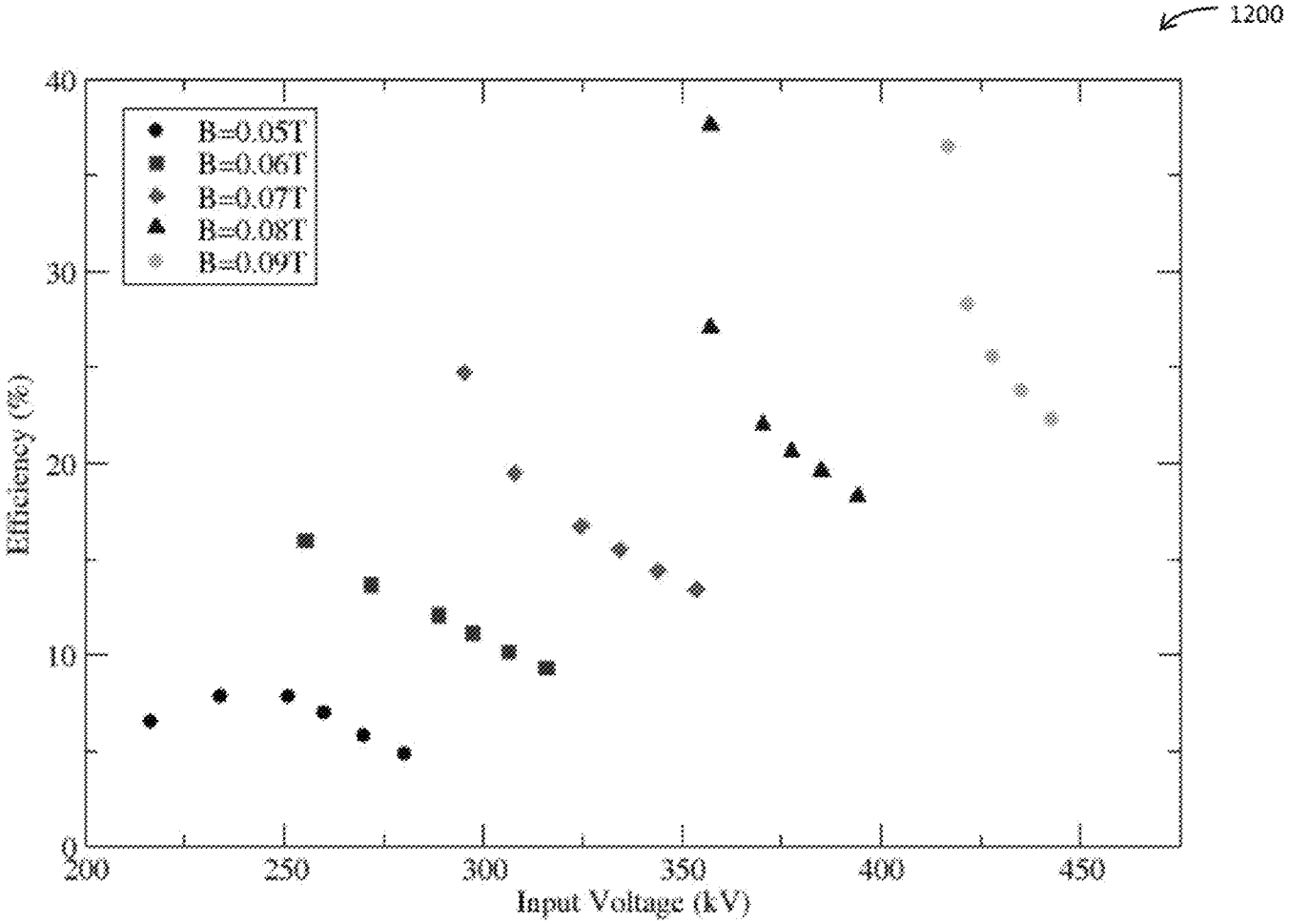
FIG. 12 is a graph illustrating output power efficiency of the magnetron illustrated in FIG. 2.

FIG. 12 plots the efficiency of the IMO 100. As shown, operation of the IMO 100 exhibited a general increase in RF efficiency as the magnetic field was increased. However, for a given magnetic field, efficiency declined as voltage was raised. Efficiency ranged from 5-37.0% with the highest values of efficiency occurring for the highest voltages sampled. Notably, for a given magnetic field, peak efficiency did not correspond with the voltage that produced peak output power.

The IMO 100 presented in the first embodiment consistently oscillates in the π mode across a wide range of magnetic fields and voltages. The IMO 100 operated in a predictable fashion obeying the Buneman-Hartree resonance condition. The π mode resonance curve was used to successfully predict where the magnetron would oscillate in voltage/magnetic field space (i.e., oscillations tracked well with the curve). Therefore, this embodiment of the present invention advantageously proved stable and reliable.

Figure 13:
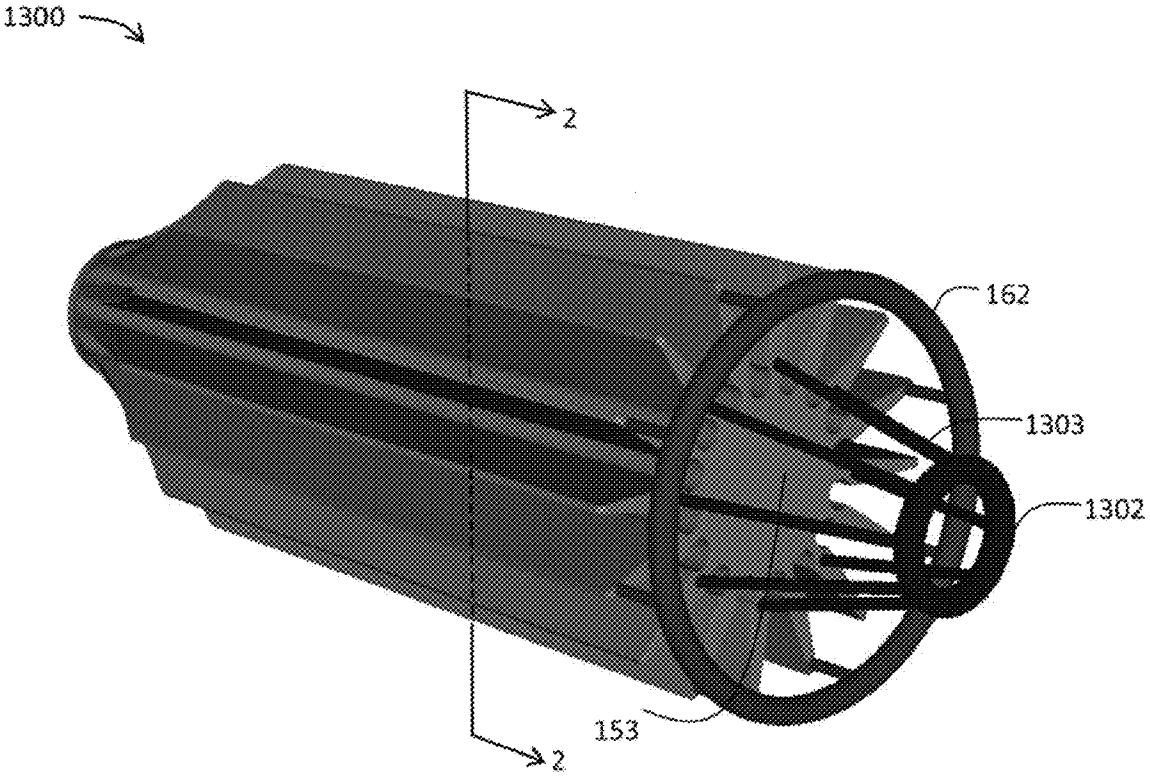
FIG. 13 is an assembled, perspective top view of a second embodiment of an anode block as used with a magnetron according to an embodiment of the present invention.

FIG. 13 illustrates a second embodiment of the inverted magnetron, defined as IMO-B 1300. IMO-B 1300 may have the same dimensions and specifications as the IMO 100, but with an added annular shaped torus, defined as a second excitation ring 1302 and a second plurality of connecting rods 1303 extending from the anode block second end 153. In one embodiment, the second plurality of connecting rods 1303 may be eight (8) in number.

The second excitation ring 1302 may be mounted to the remaining vane panels 156 of the anode block 150 via the second plurality of connecting rods 1303 that do not include the first plurality of connecting rods 161 and the mounted first excitation ring 162. Thus, the second excitation ring 162 will have opposite polarity to the first excitation ring 162. Because the second excitation ring 1302 is approximately half a wavelength downstream of the first excitation ring 162, the $TM_{01}$ mode that the second excitation ring 1302 induces may interfere constructively with the mode generated by the first excitation ring 162 and thus boost the amplitude of the wave.

For example, and without limitation, the second excitation ring 1302 may be positioned 7.56 cm away from the anode block second end 153. The second excitation ring 1302 may measure a major radius of 1.99 cm and a minor radius of 0.45 cm. The second excitation ring 1302 may be smaller in diameter than the first excitation ring 162 and may extend distally from the anode block second end 153 by the distance of the second plurality of connecting rods 1303. In some embodiments, the distance of the second plurality of connecting rods 1303 may be greater than the distance of the first plurality of connecting rods 161.

The second plurality of connecting rods 1303 may be connected to alternating vane panels 156, proximate the inner perimeter 170 of the anode block second end 153 relative to the first plurality of connecting rods 161. The second plurality of connecting rods 1303 may be located on vane panels 156 not inclusive of the first plurality of connecting rods 161. Therefore, the first plurality of connecting rods 161 and the second plurality of connecting rods 1303 may be alternated, respectively. For example, and without limitation, the second plurality of connecting rods 1303 may be located at the base 175 of the vane panels 156 on the anode block second end 153 before the vane panels 156 become defined by the resonant holes 401 and resonant channels 159. The second plurality of connecting rods 1303 may form an angle other than 90 degrees with the anode block second end 153 to accommodate the smaller diameter of the second excitation ring 1302 relative to the positioning of the second plurality of connecting rods 1303 on the anode block second end 153.

Figure 14:
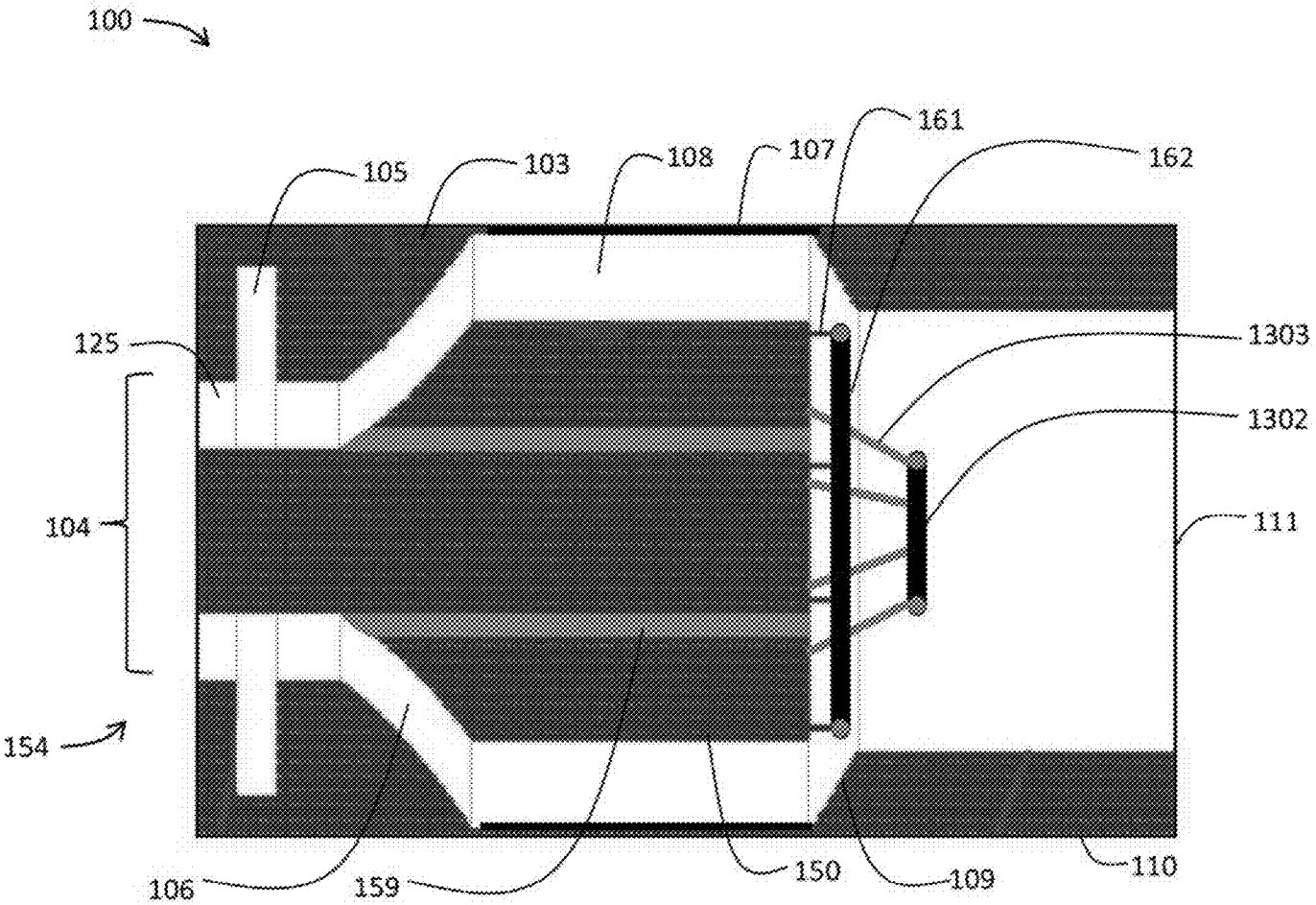
FIG. 14 is an assembled, side-sectional view of the magnetron illustrated in FIG. 1 including the second embodiment of the anode block of FIG. 13 and taken through line 2-2 of FIGS. 1 and 13.
Figure 15:
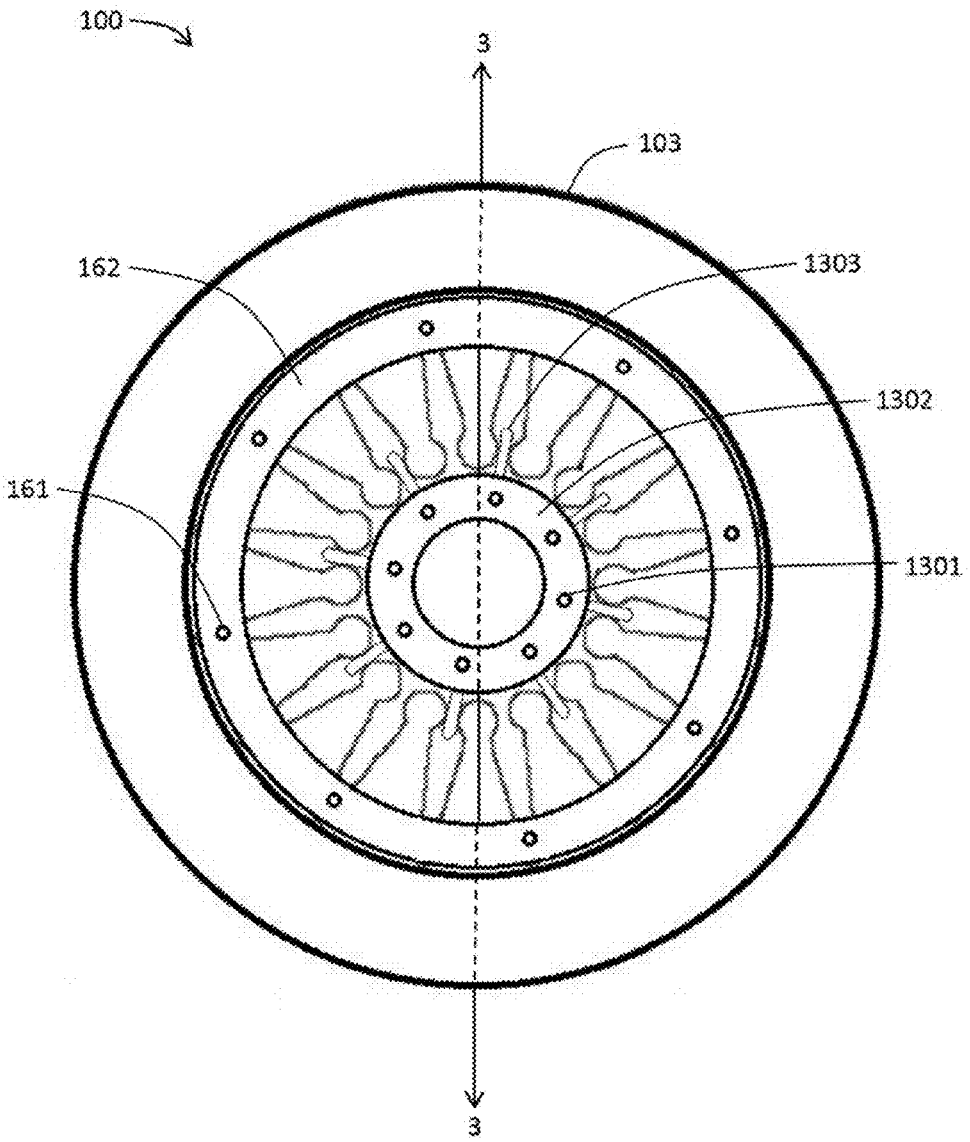
FIG. 15 is an assembled, exterior upstream view of the magnetron illustrated in FIG. 14.

FIG. 14 is a side-sectional view of the IMO-B 1300 that illustrates the second plurality of connecting rods 1303 measuring longer than the first plurality of connecting rods 161 and forming an angle between the anode block second end 153 and the second excitation ring 1302. In one embodiment, the second plurality of connecting rods 1303 may connect to the anode block second end 153 at one portion, may pass through an inner perimeter established by the first excitation ring 162, and may connect to the second excitation ring 1302 at a positioning distal to the anode block second end 153 relative to the first excitation ring 162.

Figure 16:
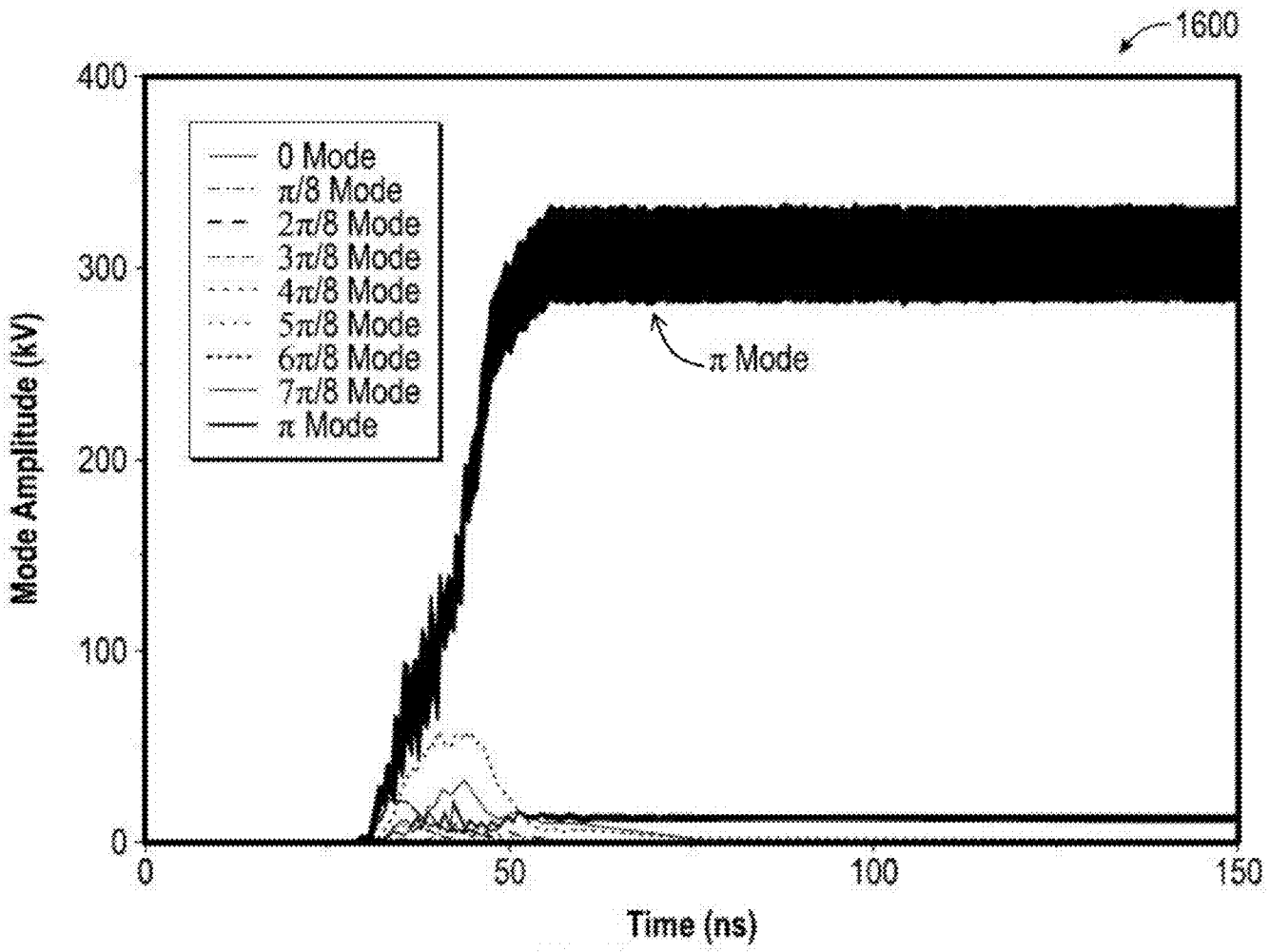
FIG. 16 is a graph illustrating evolution of magnetron modes as simulated for the magnetron illustrated in FIG. 14.
Figure 17:
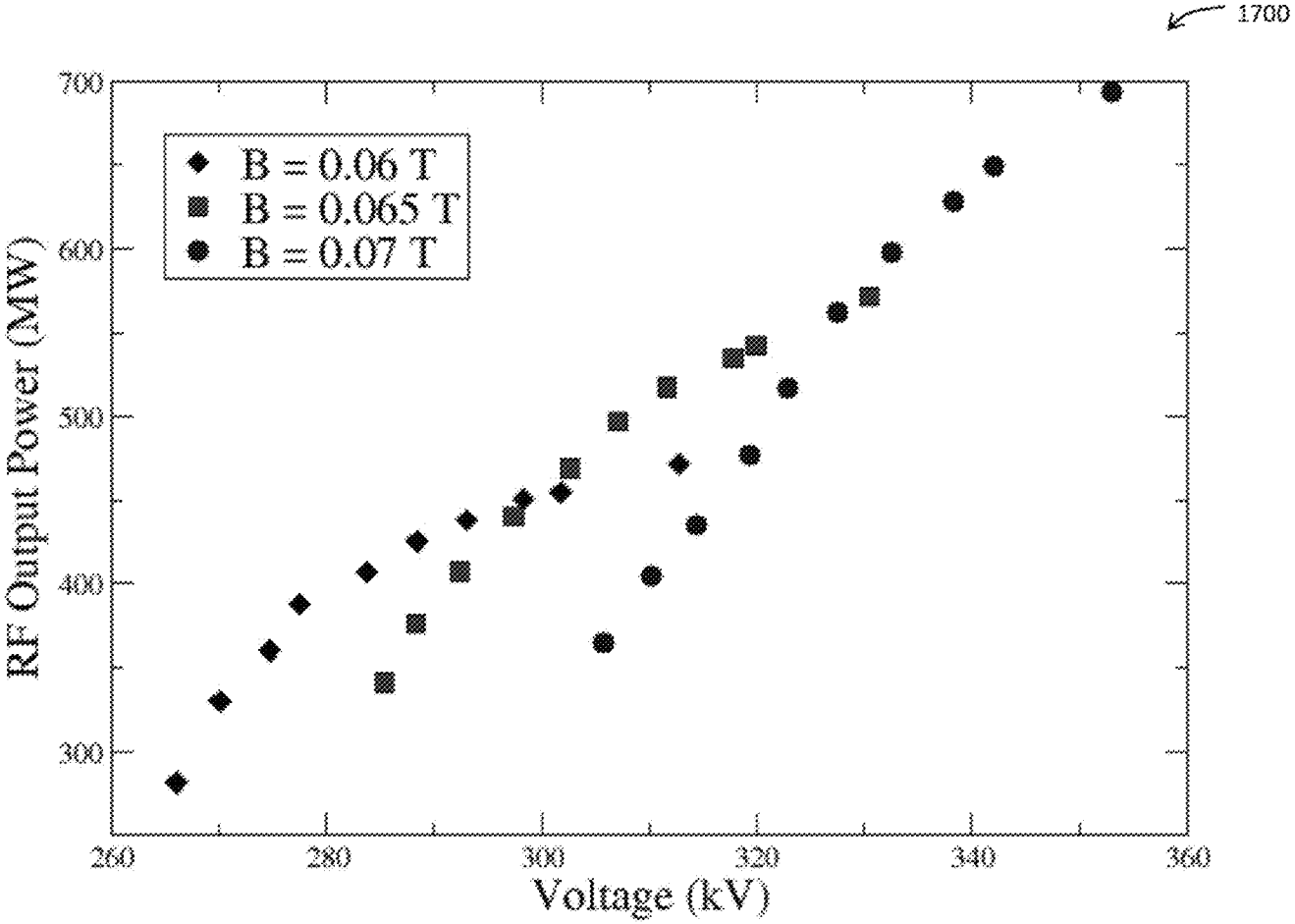
FIG. 17 is a graph illustrating output power of the magnetron illustrated in FIG. 14.
Figure 18:
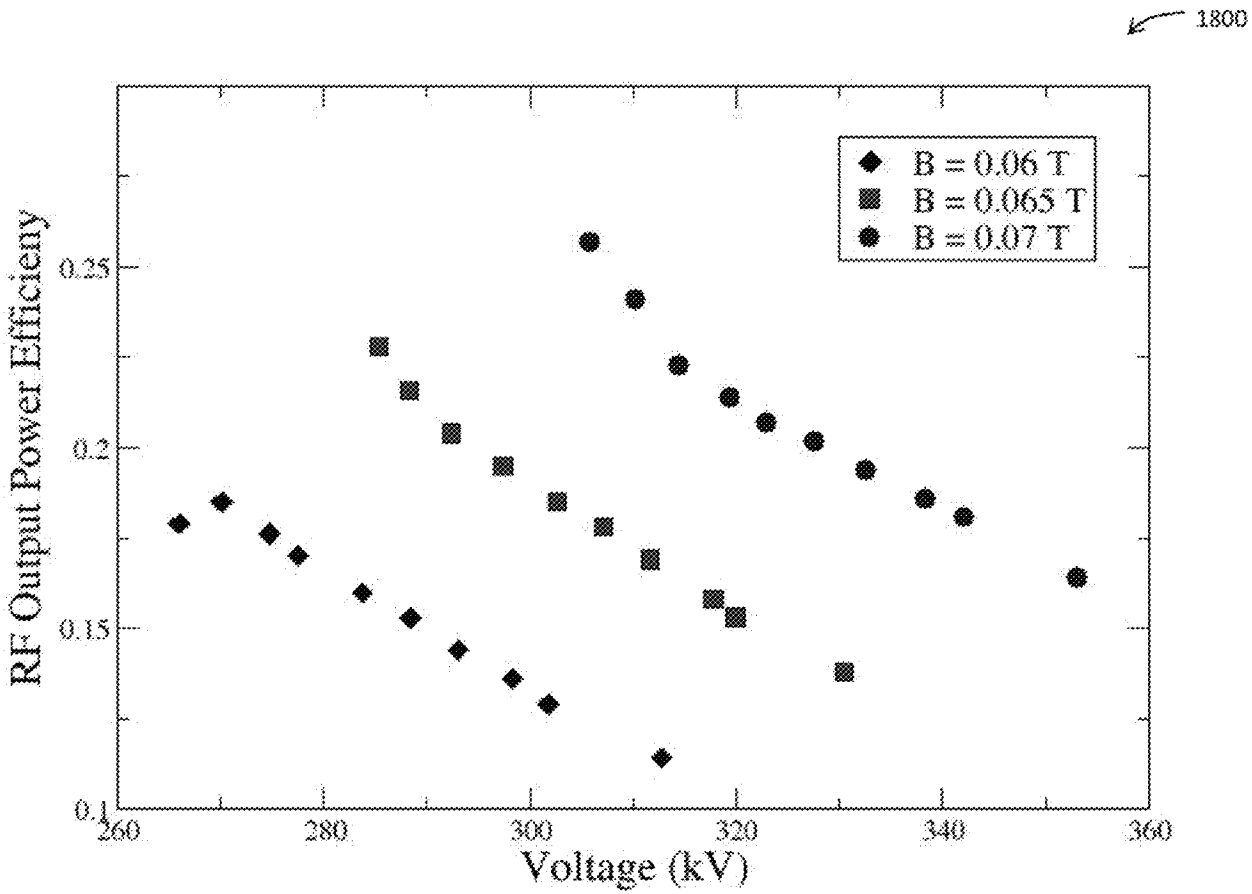
FIG. 18 is a graph illustrating output power efficiency of the magnetron illustrated in FIG. 14.

As illustrated by the graphed simulation data presented in FIGS. 16-18, addition of the second excitation ring may increase the RF output power of the IMO-B 1300 as compared to the IMO 100. The following three fields were used to test the IMO-B 1300: 0.06 T, 0.065 T and 0.07 T. For the IMO-B 1300, the reference simulation was chosen at input voltage=305 kV and B=0.065 T. This simulation is reflective of the battery of simulations that were carried out for the IMO-B 1300. The 305 kV was the dial up voltage and the resultant voltage was 307 kV.

FIG. 16 plots the mode dynamics of the IMO-B 1300 as a function of time. A small period of mode competition existed as the π mode underwent rapid growth. However, by 60 ns, all competition had dissipated and the π mode was dominant at 2 GHz for the length of the simulation.

FIG. 17 shows IMO-B 1300 RF Output power performance across a range of voltages. RF output power at saturation was approximately 496 MW. Output power efficiency was 17.8% with an input current of 9 kA and a measured voltage of 307 kV. The IMO so configured exhibited no downstream leakage current. As with the IMO 100, peak electric field amplitudes remained well below the Kilpatrick limit for RF breakdown. As with the IMO 100, the IMO-B 1300 proved to be advantageously stable and reliable over the voltage and magnetic fields sampled.

FIG. 18 shows that efficiencies for the IMO-B 1300 behave in a similar manner as the IMO, although average efficiency is slightly less.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus, the scope of the invention should be determined by the appended claims and their legal equivalents, and not by the examples given.

That which is claimed is:

1. A magnetron for delivering megawatt power at a low relativistic diode voltage comprising:

a supporting cylinder;

a field emission cathode disposed about an inner surface of the supporting cylinder;

a slow wave structure comprising an anode block comprising sixteen radially-projecting vane panels, each adjoining pair of which defines therebetween a respective one of sixteen resonant cavities, wherein each of the resonant cavities comprises a resonant channel portion positioned radially proximate to and axially coextensive with a center axis of the anode block, and wherein the anode block is positioned coaxial with and surrounded by the field emission cathode and separated therefrom by an inter-boundary void defining an interaction region; and a waveguide positioned coaxial with and coupled mechanically to the supporting cylinder and characterized by an exterior layer surrounding an interior void defining a downstream opening.

2. The magnetron according to claim 1 wherein the respective resonant channel portion of each of the sixteen resonant cavities is substantially tubular; and wherein each of the resonant cavities further comprises a wedge portion adjoined to the respective resonant channel portion.

3. The magnetron according to claim 1 further comprising a breech portion comprising:

a cylindrical annular passage having a first end and a second end;

a flaring annular passage, defining an upstream taper, that includes a narrow end in communication with the second end of the cylindrical annular passage and a wide end in communication with the interaction region; and an annular reflector chamber electrically coupled to an outer circumference of the cylindrical annular passage and characterized by a radius positioned perpendicular to a center axis of the cylindrical passage.

4. The magnetron according to claim 1 further comprising a frustoconical void, defined as a downstream taper, comprising a downstream end of the downstream taper electrically coupled the downstream opening of the waveguide, and an upstream end of the downstream taper electrically coupled to the interaction region.

5. The magnetron according to claim 1 wherein a radius of the field emission cathode is equal to 10.0 cm and a radius of the anode block is 7.1 cm; and wherein a cylindrical annular portion of the interaction region is characterized by a distance between the respective radii of the field emission cathode and the anode block.

6. The magnetron according to claim 1 wherein the anode block further comprises a first end, an anode block body, and a second end; wherein the vane panels of the anode block taper between an upstream end of the anode block body and the first end of the anode block.

7. The magnetron according to claim 1 further comprising a first excitation ring capacitively coupled to the waveguide and fixed by a first plurality of connecting rods to respective downstream edges of alternating vane panels, no pairing of which define one of the sixteen resonance cavities therebetween.

8. The magnetron according to claim 7 further comprising a second excitation ring fixed by a second plurality of connecting rods to respective downstream edges of eight (8) of the sixteen radially-projecting vane panels not inclusive of the alternating vanes; wherein the second excitation ring is capacitively coupled to the waveguide.

9. In a magnetron of a type that includes a downstream cylindrical waveguide, an improvement comprising, in combination:

a supporting cylinder;

a cathode disposed about an inner surface of the supporting cylinder; and a slow wave structure positioned coaxial with and capacitively coupled to the downstream cylindrical waveguide and including an anode block comprising sixteen radially-projecting angled vane panels, each adjoining pair of which defines therebetween a respective one of sixteen resonant cavities, wherein each of the resonant cavities comprises a resonant channel portion positioned radially proximate to and axially coextensive with a center axis of the anode block, and wherein the anode block is positioned coaxial with, and surrounded by, the cathode and separated therefrom by an inter-boundary void defining an interaction region.

10. The magnetron according to claim 9 further comprising a frustoconical void, defined as a downstream taper, positioned between a downstream end of the interaction region and an upstream end of the downstream cylindrical waveguide.

11. The magnetron according to claim 9 wherein each of the sixteen radially-projecting angled vane panels further comprise:

a base located proximate an inner perimeter of the anode block body; and an opposing pair of sides that angle toward each other to define a vane tip positioned distal to the anode block, and wherein the base is wider than the vane tip.

12. The magnetron according to claim 9 wherein the respective resonant channel portion of each of the sixteen resonant cavities is substantially tubular; and wherein each of the resonant cavities further comprises a wedge portion adjoined to the respective resonant channel portion and including a wide opening distal to the anode block and a narrow opening proximate an inner perimeter of the anode block body.

13. A magnetron for generating electromagnetic waves, comprising:

a first end of the magnetron defined as an upstream end;

a second end of the magnetron positioned axially opposite the first end of the magnetron, and defined as a downstream end;

a breech portion positioned proximate the upstream end of the magnetron, configured to receive pulsed input energy, and including an upstream opening in communication with a first end of a cylindrical annular passage, a flaring annular passage, defining an upstream taper, that includes a narrow end electrically coupled to a second end of the cylindrical annular passage and a wide end electrically coupled to the interaction region, and a cylindrical annular reflector chamber electrically coupled to an outer circumference of the cylindrical annular passage and characterized by a radius positioned perpendicular to a center axis of the cylindrical passage;

a slow wave structure comprising:

a first excitation ring, a first plurality of connecting rods, and an anode block comprising:

an anode block first end, an anode block body, an anode block second end, and a plurality of vane panels each comprising a vane panel tip, each configured to alternate between positive and negative charges, and each adjoining pair of which defines therebetween a respective resonant cavity, each comprising a respective resonant channel portion positioned radially proximate to and axially coextensive with a center axis of the anode block;

a field emission cathode surrounding the anode block body and separated therefrom by an inter-boundary void defining an interaction region; and a waveguide capacitively coupled to the first excitation ring, positioned proximate the downstream end of the magnetron, and configured to shape electromagnetic waves;

wherein at least a portion of the magnetron is configured to be operable within a magnetic field.

14. The magnetron according to claim 13 wherein the pulsed input energy has an input voltage range of 210 kV to 375 kV.

15. The magnetron according to claim 13 wherein the slow wave structure further comprises a second excitation ring, and a second plurality of connecting rods; and wherein the waveguide is further capacitively coupled to the second excitation ring.

16. The magnetron according to claim 13 wherein the vane panels are splayed distally from an anode block inner perimeter.

17. The magnetron according to claim 13 wherein a single angled vane panel is configured to be oppositely charged relative to an adjacent angled vane panel.

18. The magnetron according to claim 15 wherein the first excitation ring is mounted to the slow wave structure via the plurality of connecting rods on alternated angled vane panels and the second excitation ring is mounted to the slow wave structure via the second plurality of connecting rods on alternated angled vane panels; and wherein the first excitation ring and the second excitation ring are mounted to different angled vane panels.

19. The magnetron according to claim 15 wherein the first excitation ring has a larger diameter than the diameter of the second excitation ring.

20. The magnetron according to claim 15 wherein the second plurality of connecting rods of the second excitation ring measure longer than the plurality of connecting rods of the first excitation ring.

* * * * *